US008385807B2

(12) United States Patent
Tanaka et al.

(10) Patent No.: US 8,385,807 B2
(45) Date of Patent: Feb. 26, 2013

(54) IMAGE-BEARING MEMBER PROTECTING AGENT, PROTECTIVE LAYER FORMING DEVICE, IMAGE FORMING METHOD, PROCESS CARTRIDGE AND IMAGE FORMING APPARATUS

(75) Inventors: Shinya Tanaka, Sagamihara (JP); Hiroshi Nakai, Yokohama (JP); Kunio Hasegawa, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 337 days.

(21) Appl. No.: 12/461,235

(22) Filed: Aug. 5, 2009

(65) Prior Publication Data

US 2010/0034560 A1 Feb. 11, 2010

(30) Foreign Application Priority Data

Aug. 6, 2008 (JP) ..... 2008-203450

(51) Int. Cl.
*G03G 21/00* (2006.01)

(52) U.S. Cl. ..... 399/346

(58) Field of Classification Search ..... 399/346
See application file for complete search history.

(56) References Cited

U.S. PATENT DOCUMENTS

| | | | | |
|---|---|---|---|---|
| 3,501,294 | A | 3/1970 | Joseph | |
| 5,116,589 | A * | 5/1992 | Hoenig | 264/102 |
| 5,272,029 | A * | 12/1993 | Sakai et al. | 430/59.6 |
| 5,409,622 | A * | 4/1995 | Chapman et al. | 508/137 |
| 5,678,832 | A * | 10/1997 | Hill | 277/534 |
| 7,851,113 | B2 * | 12/2010 | Bender et al. | 430/58.2 |
| 2006/0154800 | A1 * | 7/2006 | Chen | 501/92 |
| 2006/0285897 | A1 * | 12/2006 | Sugiura et al. | 399/346 |
| 2007/0123435 | A1 * | 5/2007 | Usami | 508/100 |
| 2007/0205706 | A1 * | 9/2007 | Yamada et al. | 313/110 |
| 2007/0224528 | A1 * | 9/2007 | Yamashita et al. | 430/66 |
| 2008/0089726 | A1 * | 4/2008 | Hatakeyama et al. | 399/346 |
| 2008/0095553 | A1 | 4/2008 | Tanaka et al. | |
| 2008/0118286 | A1 | 5/2008 | Yamashita et al. | |
| 2008/0138132 | A1 | 6/2008 | Yamashita et al. | |
| 2009/0232541 | A1 * | 9/2009 | Hatakeyama et al. | 399/111 |

FOREIGN PATENT DOCUMENTS

| | | |
|---|---|---|
| EP | 396448 A * | 11/1990 |
| JP | 51-22380 | 7/1976 |
| JP | 09-202663 | 8/1997 |
| JP | 10-194711 | 7/1998 |
| JP | 11-157936 | 6/1999 |
| JP | 2000-042807 | 2/2000 |
| JP | 2002-231550 | 8/2002 |

(Continued)

OTHER PUBLICATIONS

"Momentive Performance Materials, Boron Nitride Powders NX Grades", Shanghai Ping Yiao Trading Co. Ltd., © 2006-2007.*

(Continued)

*Primary Examiner* — Walter L Lindsay, Jr.
*Assistant Examiner* — David Bolduc
(74) *Attorney, Agent, or Firm* — Harness, Dickey & Pierce, P.L.C.

(57) ABSTRACT

The present invention provides an image-bearing member protecting agent containing a fatty acid metal salt, and boron nitride, wherein the boron nitride has an oxygen content of 0.4% by mass to 4.5% by mass, and wherein the image-bearing member protecting agent is applied or attached onto a surface of an image bearing member.

20 Claims, 2 Drawing Sheets

FOREIGN PATENT DOCUMENTS

| | | |
|---|---|---|
| JP | 2004-126383 | 4/2004 |
| JP | 2006-13184 | 1/2006 |
| JP | 2006-350240 | 12/2006 |
| JP | 2007-145993 | 6/2007 |
| JP | 2008-122866 | 5/2008 |
| JP | 2008-134467 | 6/2008 |

OTHER PUBLICATIONS

Office Action for corresponding Japanese Application No. 2008-203450 dated Sep. 25, 2012.

* cited by examiner

IMAGE-BEARING MEMBER PROTECTING AGENT, PROTECTIVE LAYER FORMING DEVICE, IMAGE FORMING METHOD, PROCESS CARTRIDGE AND IMAGE FORMING APPARATUS

BACKGROUND OF THE INVENTION

1. Field of the Invention

The present invention relates to an image-bearing member protecting agent, a protective layer forming device which forms a protective layer on a surface of an image bearing member, and an image forming apparatus and a process cartridge, which includes the protective layer forming device, in an electrophotographic apparatus.

2. Description of the Related Art

Conventionally, in electrophotographic image formation, a latent electrostatic image is formed on an image bearing member made from a photoconductive material, and charged toner particles are attached to this latent electrostatic image so as to form a visible image. The visible image formed with the toner particles is transferred onto a transfer medium such as paper, a resin sheet, or the like, and then fixed on the transfer medium utilizing heat, pressure, solvent gas, or the like so as to form an output image.

Methods for the image formation are broadly classified, according to methods for charging toner particles to form a visible image, into so-called two-component developing methods in which frictional charging effected by stirring and mixing toner particles and carrier particles is utilized, and so-called one-component developing methods in which toner particles are charged without using carrier particles. Further, the one-component developing methods are classified into magnetic one-component developing methods and nonmagnetic one-component developing methods, according to whether or not magnetic force is utilized to keep toner particles on a developing roller serving as a developing member.

In image forming apparatuses, such as copiers, complex machines based upon the copiers, and the like for which high-speed processing capability and image reproducibility are required, the two-component developing methods have been employed in many cases due to demands for stable chargeability of toner particles, stable charge rising properties of the toner particles, long-term stability of image quality, and the like; whereas in compact printers, facsimiles, etc. for which space saving, cost reduction and the like are required, the one-component developing methods have been employed in many cases.

Also, nowadays in particular, colorization of output images is progressing, and demands for improvement of image quality and stabilization of image quality are increasing like never before. For the improvement of image quality, toners have been made smaller in average particle diameter, and particles of the toners have been made rounder in shape with their angular parts removed.

Generally, in an image forming apparatus which operates in accordance with any such electrophotographic image forming method, regardless of which developing method is employed, a drum-shaped or belt-shaped image bearing member (typified by a photoconductor) is uniformly charged while being rotated, a latent image pattern is formed on the image bearing member by laser light or the like, and the latent image pattern is visualized as a toner image by a developing unit and transferred onto a transfer medium.

After the toner image has been transferred onto the transfer medium, untransferred toner components remain on the image bearing member. If such residues are directly conveyed to a region for the charging step, it often hinders the image bearing member from being uniformly charged; accordingly, in general, the toner components, etc. remaining on the image bearing member are removed by a cleaning step by a cleaning unit after the transfer step, thereby bringing the surface of the image bearing member into a clean enough state, and then charging is carried out.

Thus, there are various types of physical stress and electrical stress in each step in image formation, which degrade the image bearing member, charging member and cleaning member. In attempts to solve this problem, a number of proposals for lubricants and methods of supplying lubricant components and forming films have been made thus far to reduce degradation of the image bearing member, charging member and cleaning member.

For example, Japanese Patent Application Publication (JP-B) No. 51-22380 proposes a method of forming a lubricant film on a photoconductor surface by supplying the photoconductor surface with a solid lubricant composed mainly of zinc stearate in order to lengthen the lifetimes of a photoconductor and a cleaning blade. This makes it possible to reduce abrasion of the photoconductor surface and thus lengthen the lifetime of the photoconductor.

However, it is understood that fatty acid metal salts such as zinc stearate lose their lubricating properties at an early stage due to electric discharge performed in the vicinity of the image bearing member in a charging step. Consequently, lubricating properties between the cleaning blade and the image bearing member are impaired, and toner particles pass through the cleaning blade (hereinafter also referred to as toner leakage), and thus defective images are formed.

In an attempt to solve this problem, Japanese Patent Application Laid-Open (JP-A) No. 2006-350240 proposes a method of applying an image-bearing member protecting agent which contains a fatty acid metal salt and boron nitride. Thus, the lubricating properties between a cleaning blade and an image bearing member can be maintained by means of a lubricating effect of the boron nitride even under the influence of electric discharge performed in the vicinity of the image bearing member in a charging step, and toner leakage can be prevented.

In JP-A No. 2007-145993, at least two types of higher fatty acid metal salts having different numbers of carbon atoms are used in order to improve the formability of an image-bearing member protecting agent with a large aspect ratio.

In JP-A No. 2006-350240, the boron nitride has the lubricating properties so as to prevent toner leakage. However, when the boron nitride is used for the image-bearing member protecting agent, its high lubricating properties make it difficult to remove the agent from the surface of the image bearing member, and thus the agent is attached onto the image bearing member as a film, which causes blurring of an image.

In the method of JP-A No. 2007-145993, although the formability of the image-bearing member protecting agent is improved, the lubricating property is reduced by the use of the different types of fatty acid metal salts, causing acceleration of the toner leakage and smearing on the charging member.

BRIEF SUMMARY OF THE INVENTION

The present invention is designed in light of the problems in the present situations, and an object of the present invention is to provide an image-bearing member protecting agent capable of preventing abrasion of an image bearing member, filming on the image bearing member, smearing of a charging member, and toner passing through a blade.

Another object of the present invention is to provide a protective layer forming device for forming an excellent protective layer on the surface of the image bearing member, using the image-bearing member protecting agent.

Yet another object of the present invention is to provide an image forming method and an image forming apparatus which can obtain high quality images in a stable manner for a long period of time.

Still yet another object of the present invention is to provide a process cartridge capable of obtaining high quality images in a stable manner.

The present invention is based on the foregoing findings of the inventors of the present invention, and means for solving the above problems is as follows:

<1> An image-bearing member protecting agent containing at least a fatty acid metal salt, and boron nitride, wherein the boron nitride has an oxygen content of 0.4% by mass to 4.5% by mass, and wherein the image-bearing member protecting agent is applied or attached onto a surface of an image bearing member.

<2> The image-bearing member protecting agent according to <1>, wherein the fatty acid metal salt is at least one selected from the group consisting of zinc stearate, calcium stearate, and zinc laurate.

<3> The image-bearing member protecting agent according to any one of <1> and <2>, wherein the fatty acid metal salt is zinc stearate.

<4> An image bearing member on which surface the image-bearing member protecting agent according to any one of <1> to <3> is applied or attached.

<5> A protective layer forming device which applies or attaches an image-bearing member protecting agent onto a surface of an image bearing member, wherein the image-bearing member protecting agent is the image-bearing member protecting agent according to any one of <1> to <3>.

<6> The protective layer forming device according to <5>, including a supply member by which the image-bearing member protecting agent is supplied onto the surface of the image bearing member.

<7> The protective layer forming device according to any one of <5> to <6>, further including a layer forming unit configured to press the image-bearing member protecting agent supplied onto the surface of the image bearing member against the surface so as to form a layer.

<8> The image forming method including transferring a toner image borne on an image bearing member onto a transfer medium, and applying or attaching an image-bearing member protecting agent onto a surface of the image bearing member, from which the toner image has been transferred onto the transfer medium, so as to form a protective layer, wherein the image-bearing member protecting agent is the image-bearing member protecting agent according to any one of <1> to <3>.

<9> An image forming apparatus including an image bearing member which bears a toner image formed of a toner, a transfer unit configured to transfer the toner image onto a transfer medium, and a protective layer forming device which applies or attaches an image-bearing member protecting agent onto a surface of the image bearing member, from which the toner image has been transferred onto the transfer medium, wherein the protective layer forming device is the protective layer forming device according to any one of <5> to <7>.

<10> The image forming apparatus according to <9>, further including a cleaning unit located on a downstream side of the transfer unit and on an upstream side of the protective layer forming device with respect to the rotational direction of the image bearing member and configured to be rubbed against the surface of the image bearing member so as to remove the toner remaining thereon.

<11> The image forming apparatus according to any one of <9> and <10>, wherein the image bearing member contains a thermosetting resin at least in a protective layer formed as an outermost surface layer.

<12> The image forming apparatus according to any one of <9> to <11>, wherein the image bearing member is a photoconductor.

<13> The image forming apparatus according to any one of <11> and <12>, further including a charging unit located in contact with or close to the surface of the image bearing member.

<14> The image forming apparatus according to <13>, further including a voltage applying unit configured to apply to the charging unit a voltage which includes an alternating-current component.

<15> The image forming apparatus according to any one of <9> to <14>, wherein the toner has a circularity SR, represented by Equation 1, in the range of 0.93 to 1.00.

Circularity SR=Circumferential length of a circle having the same area as projected particle area/Circumferential length of projected particle image Equation 1

<16> The image forming apparatus according to any one of <9> to <15>, wherein a ratio D4/D1 of a mass average particle diameter D4 of the toner to a number average particle diameter D1 of the toner is in the range of 1.00 to 1.40.

<17> A process cartridge including an image bearing member which bears a toner image formed of a toner, and a protective layer forming device configured to apply or attach an image-bearing member protecting agent onto a surface of the image bearing member, from which the toner image has been transferred onto a transfer medium, wherein the protective layer forming device is the protective layer forming device according to any one of <5> to <7>.

<18> The process cartridge according to <17>, further including a cleaning unit located on an upstream side of the protective layer is forming device with respect to the rotational direction of the image bearing member and configured to be rubbed against the surface of the image bearing member so as to remove the toner remaining thereon.

<19> The process cartridge according to any one of <17> and <18>, wherein the image bearing member contains a thermosetting resin at least in a protective layer formed as an outermost surface layer.

<20> The process cartridge according to any one of <17> to <19>, further including a charging unit located in contact with or close to the surface of the image bearing member.

<21> The process cartridge according to any one of <17> to <20>, wherein the toner has a circularity SR, represented by Equation 1, in the range of 0.93 to 1.00.

Circularity SR=Circumferential length of a circle having the same area as projected particle area/Circumferential length of projected particle image Equation 1

<22> The process cartridge according to any one of <17> to <21>, wherein a ratio D4/D1 of a mass average particle diameter D4 of the toner to a number average particle diameter D1 of the toner is in the range of 1.00 to 1.40.

The image-bearing member protecting agent of the present invention contains at least fatty acid metal salt and boron nitride, and the boron nitride has an oxygen content of 0.4% by mass to 4.5% by mass, so that the cleanability is improved and smearing on the charging member is lessen, and additionally the protecting capability on the image bearing member is improved. Therefore, the use of the image-bearing member protecting agent enables to significantly improve the cleanability and lessen smearing on the charging member, while the protecting capability on the image bearing member is maintained, and to prevent abrasion of the image bearing member, filming on the image bearing member, smearing on the charging member, and the toner passing through a blade.

Since the image-bearing member protecting agent of the present invention contains fatty acid metal salt, which is at least one selected from the group consisting of zinc stearate, calcium stearate, and zinc laurate, it is excellent in the cleanability and the protecting capability on the image bearing member.

The image-bearing member protecting agent is applied and attached onto the surface of the image bearing member of the present invention. Thus, the image bearing member can be used for a fairly long period of time without being replaced and high quality images can be obtained in a stable manner for a long period of time.

The protective layer forming device used in the present invention includes a supply member, by which the image-bearing member protecting agent is supplied onto the surface of the image bearing member, and the image-bearing member protecting agent is supplied via the supply member onto the image bearing member so as to uniformly supply the protecting agent onto the surface thereof even when the image-bearing member protecting agent is soft, thereby forming an excellent protective layer for the image bearing member.

The protective layer forming device used in the present invention includes a layer forming unit configured to press the image-bearing member protecting agent supplied onto the surface of the image bearing member against the surface so as to form a layer. Thus, the image-bearing member protecting agent supplied onto the surface of the image bearing member can be formed into an excellent protective layer for the image bearing member.

The image forming method and image forming apparatus of the present invention respectively include a step of forming an image bearing member protecting layer and a protective layer forming device, so as to form an excellent protective layer on the surface of the image bearing member. Thus, the image bearing member can be used for a fairly long period of time without being replaced and high quality images can be obtained in a stable manner for a long period of time.

According to the image forming apparatus of the present invention, when the image bearing member contains a thermosetting resin in the outermost surface layer, the image-bearing member protecting agent can protect the image bearing member from being deteriorated by electrical stress caused by the charging member, and thus the image-bearing member protecting agent allow the image bearing member containing the thermosetting resin to continuously provide long durability against mechanical stress applied thereon. Thus, the image bearing member can be used for a fairly long period of time without being replaced, and high quality images can be obtained in a stable manner for a long period of time.

The image forming apparatus of the present invention include a cleaning unit located on a downstream side of the transfer unit and on an upstream side of the protective layer forming device with respect to the rotational direction of the image bearing member and configured to be rubbed against the surface of the image bearing member so as to remove the toner remaining thereon. Before the protective layer is formed, the residue which mainly contains the toner on the image bearing member can be removed by the cleaning member, so that the residue is not mixed in the protective layer. Thus, a stable protective layer can be obtained so as to provide high quality images in a stable manner for a long period of time.

The image forming apparatus of the present invention includes the protective layer for image-bearing member containing virtually no metal component formed on the image bearing member, when the charging unit is located in contact with or close to the surface of the image bearing member. Thus, the image bearing member can be used without being exposed to much electrical stress cause by the charging unit, so as to obtain high quality images in a stable manner for a long period of time. Moreover, the surface of the image bearing member is not smeared with a metal oxide or the like, and thus the charging unit less changes over time, thereby improving durability.

According to the image forming apparatus of the present invention, because the protective layer formed on the surface of the image bearing member advantageously extremely minimizes changes in the surface condition thereof, cleaning can be stably performed for a long period of time even in the case of using a toner having a large circularity or a toner having a small average particle diameter, in which the quality of the cleaning greatly varies depending on changes in the condition of the image bearing member. Therefore, high quality images can be obtained in a stable manner for a long period of time.

Since the process cartridge of the present invention includes the protective layer forming device including the image-bearing member protecting agent, an excellent protective layer can be formed on the surface of the image bearing member, and the image bearing member can be used without being replaced for a long period of time. Thus, it is possible to greatly lengthen the period of time for which the process cartridge can be used without being replaced. Therefore, low running cost and reduction of large amount of waste can be achieved.

According to the process cartridge of the present invention, when the image bearing member contains a thermosetting resin at least in the outermost surface layer, the image-bearing member protecting agent can protect the image bearing member from being deteriorated by electrical stress, and thus the image-bearing member protecting agent allow the image bearing member containing the thermosetting resin to continuously provide long durability against mechanical stress applied thereon. Thus, it is possible to greatly lengthen the period of time for which the process cartridge can be used without being replaced. Therefore, low running cost and reduction of large amount of waste can be achieved.

The process cartridge of the present invention includes the protective layer for the image-bearing member containing virtually no metal component formed on the image bearing member, when the charging unit is located in contact with or close to the surface of the image bearing member. Thus, the image bearing member can be used without being exposed to much electrical stress caused by the charging unit, so as to obtain high quality images in a stable manner for a long period of time. Moreover, the surface of the image bearing member is not smeared with a metal oxide or the like, and thus the charging unit less changes over time, thereby improving durability. Therefore, low running cost and reduction of large amount of waste can be achieved.

DETAILED DESCRIPTION OF THE INVENTION

Figure 1:
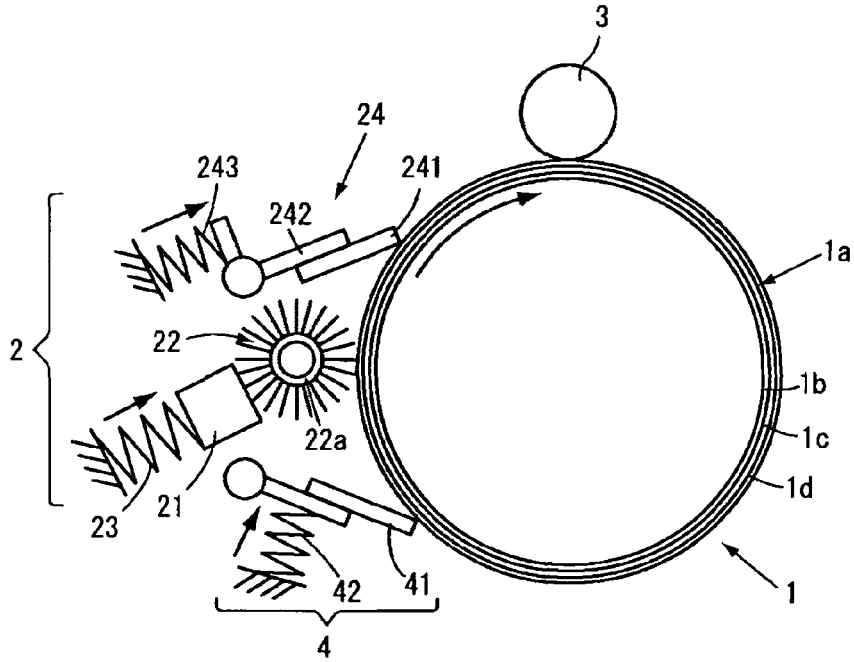
FIG. 1 is an enlarged view of a configuration example of a protective layer forming device according to the present invention.
Figure 2:
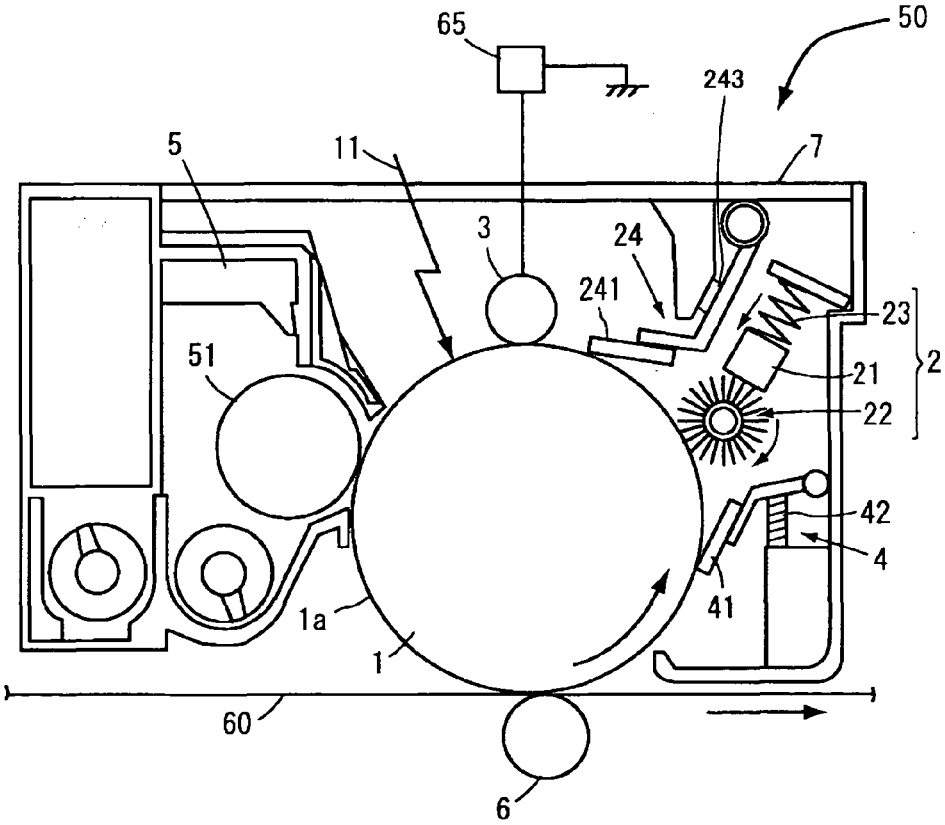
FIG. 2 is an enlarged view of a configuration example of a process cartridge according to the present invention.
Figure 3:
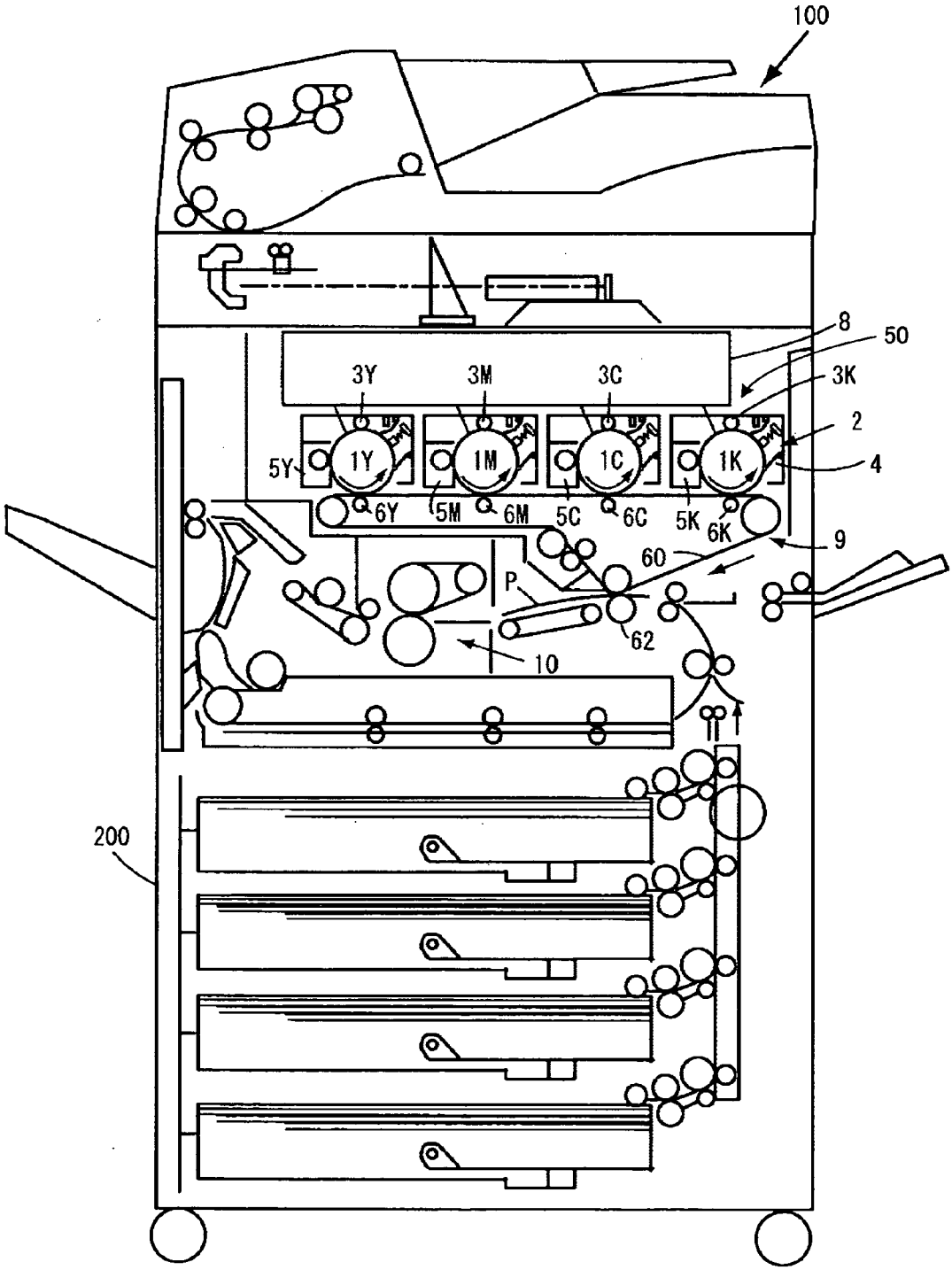
FIG. 3 is a schematic configuration view showing a configuration example of an image forming apparatus including a protective layer forming device and a process cartridge according to the present invention.

Hereinafter, an embodiment of the present invention will be explained with reference to the drawings. FIG. 1 is a schematic configuration illustrating a principle of a protective layer forming device 2 used in the present invention. FIG. 2 is a schematic configuration of a process cartridge 50 including the protective layer forming device 2. FIG. 3 is a schematic configuration of an image forming apparatus 100 including a process cartridge 50 which includes the protective layer forming device 2.

As shown in FIG. 3, the image forming apparatus 100 includes a drum-shaped photoconductor 1, which is an image bearing member (hereinafter referred to as "photoconductor drum"). Around the photoconductor drum 1, a charging roller 3 serving as a charging unit, developing unit 5, a transfer roller 6 serving as a transfer unit, a cleaning unit 4 and a protective layer forming device 2 are disposed. Of these, the photoconductor drum 1, the protective layer forming device 2, the charging roller 3, the cleaning unit 4, and the developing unit 5 are housed in a casing 7 shown in FIG. 2 so as to configure a process cartridge 50. In this embodiment, four process cartridges 50 are arranged side by side so as to form a toner image of each color of yellow, magenta, cyan, and black. Components for yellow, magenta, cyan, and black are respectively identified with symbols (Y), (M), (C), and (K). For example, process cartridges of yellow, magenta, cyan, and black are respectively shown as process cartridges 50(Y), 50(M), 50(C), 50(K).

The configurations of each of process cartridges are the same, except that the colors of toners used are different. Therefore, the symbols (Y), (M), (C), and (K) are omitted, except for the explanation of color image formation.

In the process cartridges 50(Y), 50(M), 50(C), 50(K), the respective regions between charging rollers 3(Y), 3(M), 3(C), 3(K) and the developing units 5(Y), 5(M), 5(C), 5(K) are respectively irradiated with laser beam 11 shown in FIG. 2 from an optical scanning device 8 serving as a latent electrostatic image forming unit, so as to form latent electrostatic images corresponding to respective colors.

Under the transfer rollers 6(Y), 6(M), 6(C), 6(K), an intermediate transfer unit 9, a fixing unit 10 and a paper feed device 200 are arranged. The intermediate transfer unit 9 includes a belt-shaped intermediate transfer medium 60 which is winded around a plurality of roller members. The intermediate transfer medium 60 is configured to rotationally driven in a clockwise direction in FIG. 3.

Next, a process for image formation by the image forming apparatus 100 will be explained with an example of a negative-positive process. The photoconductor drums 1(Y), 1(M), 1(C), 1(K), each of which is typified by a photoconductor having an organic photoconductive layer (OPC) shown in FIG. 1, are subjected to charge elimination by a charge-eliminating lamp (not shown) or the like, then the photoconductor drums 1(Y), 1(M), 1(C), 1(K) are negatively charged in a uniform manner by the charging rollers 3(Y), 3(M), 3(C), 3(K). When each of the photoconductor drums 1 is charged by each of the charging rollers 3, a voltage of appropriate intensity or a charged voltage obtained by superimposing an AC voltage onto the voltage, i.e. a voltage having an AC component, which is suitable for charging the photoconductor drum 1 to a desired electric potential, is applied by a voltage applying device 65 (shown in FIG. 2) to each of the charging rollers 3.

On the charged photoconductor drum 1, an electrostatic latent image is formed utilizing the laser beam 11 applied by the latent electrostatic image forming unit 8 (the absolute value of the electric potential of the exposed portion is smaller than that of the electric potential of the unexposed portion). The laser beam 11 is emitted from a semiconductor laser, and the surface of the photoconductor drum 1 (hereinafter referred to as a photoconductor drum surface 1*a*) is scanned in the direction of the rotational shaft of the photoconductor drum 1, using a multifaceted mirror of a polygonal column (polygon mirror) or the like which rotates at high speed.

As shown in FIG. 2, the thus formed latent electrostatic image is developed with a developer which contains toner particles or a mixture of toner particles and carrier particles, which is supplied onto the developing roller 51 serving as a developer bearing member in the developing unit 5, so as to form a visible toner image. When the latent image is developed, a voltage of appropriate intensity or a developing bias obtained by superimposing an AC voltage onto the voltage is applied from a voltage applying mechanism (not shown) to a development sleeve 51, with the intensity being between the intensities of the voltages for the exposed portion and the unexposed portion of the photoconductor drum 1. The step for forming a toner image is performed corresponding to each color of yellow, magenta, cyan, and black.

Toner images formed on photoconductor drums 1 for respective colors are respectively transferred onto the intermediate transfer medium 60 in sequence by the transfer rollers 6. An electric potential having the opposite polarity to the polarity of the toner charging is preferably applied to each of the transfer rollers 6 as a transfer bias.

After transferring, toner particles remaining on each photoconductor drum 1 are recovered into a toner recovery chamber inside the cleaning unit 4 by the cleaning blade 41 constituting the cleaning unit 4. The cleaning blade 41 is pressed by a compression coil spring 42 as a biasing means so that the tip of the cleaning blade 41 is in contact with the photoconductor drum surface 1*a*. The cleaning blade 41 is in contact with the photoconductor drum surface 1*a* at an angle related to a so-called counter type (reading type).

The toner image which has been transferred from the intermediate transfer medium 60 is disposed facing the intermediate transfer medium 60 before the fixing unit 10, and transferred at a time onto a transfer medium P such as paper fed from a paper feeding device 200 by a secondary transfer roller 62 on which a secondary transfer bias is applied. The toner image transferred onto the transfer medium P is fixed thereon by the fixing unit 10. The image forming apparatus 100 of the present embodiment has been explained as an example of the color image forming apparatus, but it may be an image forming apparatus for forming a monochrome image. The image forming apparatus is not limited to printers, copiers, and may be multi-functional devices having functions of a facsimile, printer, copier and the like.

Next, the configuration of the protective layer forming device 2 provided in the process cartridge 50 will be explained with reference to FIG. 1. The protective layer forming device 2 is arranged facing the photoconductor drum 1. The protective layer forming device 2 is composed of an image-bearing member protecting agent 21, a protecting agent supply member 22 configured to supply the photoconductor drum 1 with the image-bearing member protecting agent 21, and a protective layer forming unit 24 and the like.

The image-bearing member protecting agent 21 is powder formed into a block shape, and in contact with the protecting agent supply member 22 which may be formed into a brush, by pressing force applied by compression coil spring 23. The protecting agent supply members 22 rotate at a linear velocity different from that of the photoconductor drum 1 and rub the surface of the photoconductor drum 1, so as to supply the photoconductor drum surface 1*a* with the image-bearing member protecting agent 21 held on the surface of the protecting agent supply member 22. The image-bearing member protecting agent 21 supplied onto the surface of the photoconductor drum surface 1*a* is formed into a protective layer 1*d* thereon. The image-bearing member protecting agent 21 is formed into a protective layer 1*d*, which is thinned by a protective layer forming unit 24.

The image forming method according to the present invention include a transfer step of transferring a toner image borne on the photoconductor drum 1 onto the intermediate transfer medium 60, and a protective layer forming step of applying or attaching the image-bearing member protecting agent 21 onto the photoconductor drum surface 1*a*, from which the toner image has been transferred onto the intermediate transfer medium 60, so as to form a protective layer.

In the present embodiment, a plurality of toner images are once transferred onto the intermediate transfer medium 60, and then transferred at a time onto the recording medium P by the secondary transfer roller 62. Thus, the intermediate transfer medium 60 serves as a transfer medium. On the other hand, when a single-color toner formed on the photoconductor drum surface 1*a* is transferred onto the recording medium P, the recording medium P serves as a transfer medium.

The image-bearing member protecting agent 21 of the present embodiment contains at least a fatty acid metal salt and boron nitride. Examples of the fatty acid metal salt include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate, and combinations thereof.

The protective layer forming unit 24 includes a blade 241 serving as a layer forming member, a blade support 242 for supporting the blade 241, and a compression coil spring 243 as a biasing unit for biasing the blade 241 against the photoconductor drum surface 1*a*. The blade 241 is mounted on the blade support 242 by any method such as adhesion or fusion bonding, and disposed in such manner that the tip of the blade 241 is in contact with the photoconductor drum surface 1*a*.

The material used for the blade 241 is not particularly limited, and known elastic materials for cleaning blades can be used. Examples thereof include a urethane rubber, hydrin rubber, silicone rubber and fluorine rubber. These may be used alone or in a blended manner. Additionally, a portion of the rubber blade, which comes into contact with the photoconductor drum 1, may be coated or impregnated with a low friction coefficient material. Further, in order to adjust the hardness of the elastic material used, fillers such as organic fillers or inorganic fillers may be dispersed in the elastic material.

The thickness of the blade 241 cannot be unequivocally defined because the thickness is decided in view of the force applied when the blade is pressed. The thickness is preferably approximately 0.5 mm to 5 mm, and more preferably approximately 1 mm to 3 mm.

Similarly, the length L of the blade 241 which protrudes from the blade support 242 and may bend, so-called free length, cannot be unequivocally defined because the length is decided in view of the force applied. The length is preferably approximately 1 mm to 15 mm, and more preferably approximately 2 mm to 10 mm.

Another structure of the protective layer forming member may be employed in which an elastic layer of a resin, rubber, elastomer, etc. is formed over a surface of an elastic metal blade such as a spring plate, using a coupling agent, a primer component, etc. as necessary, by a method such as coating or dipping, then may be subjected to thermal curing or the like, and further subjected to surface polishing or the like, as necessary. The thickness of the elastic metal blade is preferably approximately 0.05 mm to 3 mm, and more preferably approximately 0.1 mm to 1 mm. In order to prevent the elastic metal blade from being twisted, the blade may be bent in a direction substantially parallel to a support shaft after the installation of the blade.

As the material for forming the surface layer of the blade 241, a fluorine resin such as PFA, PTFE, FEP or PVdF, a fluorine rubber, a silicone elastomer such as methylphenyl silicone elastomer, or the like may be used with the addition of a filler, as necessary. However, the material is not limited thereto.

The force with which the photoconductor drum 1 is pressed by the blade 241 is sufficient as long as it allows the image-bearing member protecting agent 21 to spread to be formed into a protective layer 1*d* or a protective film. The force is preferably in the range of 5 gf/cm to 80 gf/cm, and more preferably in the range of 10 gf/cm to 60 gf/cm, as a linear pressure.

A brush-like member is preferably used as the protecting agent supply member 22; in this case, brush fibers of the brush-like member preferably have flexibility to reduce mechanical stress on the photoconductor drum surface 1*a*.

As the material for the flexible brush fibers, one or more generally known materials may be used. Specifically, resins having flexibility among the following materials may be used: polyolefin resins such as polyethylene and polypropylene; polyvinyl-resins and polyvinylidene resins such as polystyrene, acrylic resins, polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; styrene-acrylic acid copolymers; styrene-butadiene resins; fluorine resins such as polytetrafluoroethylene, polyvinyl fluoride, polyvinylidene fluoride and polychlorotrifluoroethylene; polyesters; nylons; acrylics; rayons; polyurethanes; polycarbonates; phenol resins; amino resins such as urea-formaldehyde resins, melamine resins, benzoguanamine resins, urea resins and polyamide resins; and the like.

To adjust the extent to which the brush bends, diene rubber, styrene-butadiene rubber (SBR), ethylene propylene rubber, isoprene rubber, nitrile rubber, urethane rubber, silicone rubber, hydrin rubber, norbornene rubber and the like may be used in combination.

A support 22*a* for the protecting agent supply member 22 may be a stationary support or a roll-shaped rotatable support. The protecting agent supply member 22 having the roll-shaped support 22*a* is exemplified by a roll brush formed by spirally winding a tape made of a pile fabric formed of brush fibers around a metal core. Each brush fiber preferably has a diameter of approximately 10 μm to 500 μm and a length of 1 mm to 15 mm, and the number of the brush fibers is preferably 10,000 to 300,000 per square inch ($1.5\times10^7$ to $4.5\times10^8$ per square meter).

For the protecting agent supply member 22, use of a material having a high brush fiber density is highly desirable in terms of uniformity and stability of the supply. It is preferred that one fiber be formed from several to several hundreds of fine fibers. Specifically, 50 fine fibers of 6.7 decitex (6 denier) may be bundled together and planted as one fiber, as exemplified by the case of 333 decitex=6.7 decitex×50 filaments (300 denier=6 denier×50 filaments).

Additionally, if necessary, the brush surface may be provided with a coating layer for the purpose of stabilizing the shape of the brush surface, the environment, and the like. As a component of the coating layer, the component capable of deforming in conformity to the bending of the brush fibers is preferably used, and the component is not limited in any way as long as it can maintain its flexibility. Examples of the component include polyolefin resins such as polyethylene, polypropylene, chlorinated polyethylene and chlorosulfonated polyethylene; polyvinyl resins and polyvinylidene resins, such as polystyrene, acrylics (e.g. polymethyl methacrylate), polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; silicone resins including organosiloxane bonds, and modified products thereof (e.g. modified products made of alkyd resins, polyester resins, epoxy resins, polyurethanes, etc.); fluorine resins such as perfluoroalkyl ethers, polyfluorovinyl, polyfluorovinylidene and polychlorotrifluoroethylene; polyamides; polyesters; polyurethanes; polycarbonates; amino resins such as urea-formaldehyde resins; epoxy resins; and combinations of these resins.

Next, a photoconductor drum 1 suitably used in the present embodiment will be explained.

The photoconductor drum 1 used in the present invention includes a conductive support 1*b*, and a photosensitive layer 1*c* provided on the conductive support 1*b* as shown in FIG. 1. The structure of the photosensitive layer 1*c* is selected from a single-layer structure in which a charge generating material and a charge transporting material are present in a mixed manner, a regular layer structure in which a charge transporting layer is provided on a charge generating layer, and an opposite layer structure in which a charge generating layer is provided on the charge transporting layer. Additionally, a protective layer 1*d* may be provided on the photosensitive layer 1*c* in order to improve the mechanical strength, abrasion resistance, gas resistance, cleanability, etc. of the photoconductor drum 1. Further, an underlying layer may be provided between the photosensitive layer 1*c* and the conductive support 1*b*. Also, if necessary, an appropriate amount of a plasticizer, an antioxidant, a leveling agent, etc. may be added to each layer.

As the conductive support 1*b*, a material exhibiting conductivity of $10^{10}$ Ω·cm or less in volume resistance is used. Examples of the conductive support 1*b* include those formed by coating a film-like or cylindrical piece of plastic or paper with the material having a conductivity of $10^{10}$ Ω·cm or less in volume resistance, specifically a metal such as aluminum, nickel, chrome, nichrome, copper, gold, silver or platinum or a metal oxide such as tin oxide or indium oxide by means of vapor deposition or sputtering; a plate of aluminum, aluminum alloy, nickel, stainless, etc.; and a tube produced by forming the plate into a drum-shaped tube by means of drawing, extrusion, etc. and then surface-treating the tube by means of cutting, superfinishing, polishing, etc. A drum-shaped conductive support 1*b* preferably has a diameter of 20 mm to 150 mm, preferably 24 mm to 100 mm, and more preferably 28 mm to 70 mm. When the drum-shaped conductive support 1*b* has a diameter of less than 20 mm, it is physically difficult to dispose, around the drum, a plurality of devices and units for charging, exposing, developing, transferring and cleaning. When the drum-shaped conductive support 1*b* has a diameter of greater than 150 mm, it is undesirable because the size of the image forming apparatus 100 is enlarged. Particularly in the case where the image forming apparatus 100 is of tandem type, it is necessary to mount a plurality of photoconductor drums 1 therein. Thus, the diameter of the conductive support 1*b* is preferably 70 mm or less, and more preferably 60 mm or less. The endless nickel belt and the endless stainless steel belt disclosed in JP-A No. 52-36016 may be used as the conductive support 1*b*.

Examples of the underlying layer of the photoconductor drum 1 include a layer mainly composed of a resin, a layer mainly composed of a white pigment and a resin, and an oxidized metal film obtained by chemically or electrochemically oxidizing the surface of a conductive substrate; preference is given to the layer mainly composed of a white pigment and a resin. Examples of the white pigment include metal oxides such as titanium oxide, aluminum oxide, zirconium oxide and zinc oxide; of these, it is most preferable to use titanium oxide which is excellent in preventing penetration of electric charge from the conductive substrate. Examples of the resin used for the underlying layer include thermoplastic resins such as polyamide, polyvinyl alcohol, casein and methyl cellulose, and thermosetting resins such as acrylics, phenol resins, melamine resins, alkyds, unsaturated polyesters and epoxies. These may be used alone or in combination.

Examples of the charge generating material of the photoconductor drum 1 include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, indanthrone pigments, squarylium pigments and phthalocyanine pigments; and inorganic materials such as selenium, selenium-arsenic, selenium-tellurium, cadmium sulfide, zinc oxide, titanium oxide and amorphous silicon. These may be used alone or in combination. The underlying layer may have a single-layer structure or a multilayer structure.

Examples of the charge transporting material of the photoconductor drum 1 include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives and triphenylmethane derivatives. These may be used alone or in combination.

Binder resins used for forming the photosensitive layer 1*c* of the charge generating layer and the charge transporting layer are electrically insulative and may be selected from known thermoplastic resins, thermosetting resins, photocurable resins, photoconductive resins and the like. Suitable examples thereof include, but are not limited to, thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyesters, phenoxy resins, (meth)acrylic resins, polystyrene, polycarbonates, polyarylate, polysulphone, polyethersulphone and ABS resins; thermosetting resins such as phenol resins, epoxy resins, urethane resins, melamine resins, isocyanate resins, alkyd resins, silicone resins and thermosetting acrylic resins; and photoconductive resins such as polyvinylcarbazole, polyvinylanthracene and polyvinylpyrene. These may be used alone or in combination.

Examples of the antioxidant include the following compounds:

Monophenolic Compounds 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 3-t-butyl-4-hydroxyanisole and the like;

Bisphenolic Compounds 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) and the like;

Polymeric Phenolic Compounds 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocophenols and the like;

Phenylenediamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine and the like;

Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like;

Organic Sulfur Compounds dilauryl-3,3'-thiodipropionate, distearyl-3,3'-thiodipropionate, ditetradecyl-3,3'-thiodipropionate and the like;

Organic Phosphorus Compounds triphenylphosphine, tri(nonylphenyl)phosphine, tri(dinonylphenyl)phosphine, tricresylphosphine, tri(2,4-dibutylphenoxy)phosphine and the like.

For the plasticizer, a resin such as dibutyl phthalate or dioctyl phthalate generally used as a plasticizer can be used without the need to change it. It is appropriate that the amount of the plasticizer used be 0 parts by mass to 30 parts by mass per 100 parts by mass of the binder resin.

A leveling agent may be added into the charge transporting layer. Examples of the leveling agent include silicone oils such as dimethyl silicone oil and methylphenyl silicone oil; and polymers or oligomers having perfluoroalkyl groups in their side chains. It is appropriate that the amount of the leveling agent used be 0 parts by mass to 1 part by mass per 100 parts by mass of the binder resin.

As described above, the protective layer 1*d* is provided in order to improve the mechanical strength, abrasion resistance, gas resistance, cleanability, etc. of the photoconductor drum 1. Examples of the material for the protective layer 1*d* include polymers, and polymers with an inorganic filler dispersed therein, both of which have greater mechanical strength than the photosensitive layer 1*c*. The polymer used for the protective layer 1*d* may be thermoplastic polymers or thermosetting polymers, with preference being given to the thermosetting polymers because it has high mechanical strength and is highly capable of reducing abrasion caused by friction with a cleaning blade 41. As long as the protective layer 1*d* is thin, there may be no problem if it does not have a charge transporting capability; however, when the protective layer 1*d* without having the charge transporting capability is formed so as to be thick, the photoconductor drum 1 is easily caused to decrease in sensitivity, increase in electric potential after exposure, and increase in residual potential, so that it is desirable to mix the above-mentioned charge transporting material into the protective layer 1*d* or use a polymer having the charge transporting capability for the protective layer 1*d*. Generally, the photosensitive layer 1*c* and the protective layer 1*d* greatly differ from each other in mechanical strength, so that once the protective layer 1*d* is abraded owing to friction with the cleaning blade 41 and thusly disappears, the photosensitive layer 1*c* is also abraded; therefore, when the protective layer 1*d* is provided, it is important to make it have a sufficient thickness. The protective layer 1*d* has a thickness 0.01 μm to 12 μm, preferably 1 μm to 10 μm, and more preferably 2 μm to 8 μm. When the thickness of the protective layer 1*d* is less than 0.01 μm, the protective layer 1*d* is so thin that the protective layer 1*d* tends to be removed owing to friction with the cleaning blade 41, and abrasion of the photosensitive layer 1*c* progresses through the missing parts. When the thickness of the protective layer 1*d* is more than 12 μm, the photoconductor drum is easily caused to decrease in sensitivity, increase in electric potential after exposure, and increase in residual potential. Moreover, when a polymer having the charge transporting capability is used, the cost of the polymer increases.

As the polymer used for the protective layer 1*d*, a polymer, which is transparent to writing light upon image formation and excellent in insulation, mechanical strength and adhesiveness, is preferably used. Examples thereof include resins such as ABS resins, ACS resins, olefin-vinyl monomer copolymers, chlorinated polyethers, allyl resins, phenol resins, polyacetals, polyamides, polyamide-imides, polyacrylates, polyallylsulfones, polybutylene, polybutylene terephthalate, polycarbonates, polyethersulfones, polyethylene, polyethylene terephthalate, polyimides, acrylic resins, polymethylpentene, polypropylene, polyphenylene oxides, polysulfones, polystyrenes, AS resins, butadiene-styrene copolymers, polyurethanes, polyvinyl chloride, polyvinylidene chloride and epoxy resins. These polymers may be thermoplastic polymers. However, by the use of a thermosetting polymer, which is produced by cross-linkage with a multifunctional cross-linking agent having an acryloyl group, carboxyl group, hydroxyl group, amino group, and the like so as to enhance mechanical strength of the polymer, the protective layer 1*d* increases in mechanical strength, thereby greatly reducing abrasion of the surface layer caused by friction with the cleaning blade.

As described above, the protective layer 1*d* preferably has the charge transporting capability. In order for the protective layer 1*d* to have the charge transporting capability, it is possible to employ a method in which a polymer used for the protective layer 1*d* and the above-mentioned charge transporting material are mixed together, or a method in which a polymer having the charge transporting capability is used as the protective layer 1*d*, with the latter method being preferable because the photoconductor drum 1 which is highly sensitive and does not increase much in electric potential after exposure or in residual potential can be obtained.

The image bearing member of the present embodiment has been explained as the photoconductor drum 1 on which a latent electrostatic image is formed, however, it may be an intermediate transfer medium 60 used in image formation by a so-called intermediate transfer method in which color toner images formed on photoconductor drums 1 are primarily transferred so as to be superimposed on top of one another, and then transferred onto a transfer medium P such as paper as shown in FIG. 3.

The intermediate transfer medium 60 preferably exhibits conductivity of $10^5$ Ω·cm to $10^{11}$ Ω·cm in volume resistance. When the volume resistance is lower than $10^5$ Ω·cm, a phenomenon of so-called transfer dust may arise in which toner images become unstable owing to electric discharge, when the toner images are transferred from the photoconductor drums 1 onto the intermediate transfer medium 60. When the volume resistance is higher than $10^{11}$ Ω·cm, opposing electric charge to that of a toner image may remain on the intermediate transfer medium 60 and thus an after-image may appear on the next image, after the toner image has been transferred from the intermediate transfer medium 60 onto a transfer medium P such as paper.

For the intermediate transfer medium 60, a belt-shaped or cylindrical plastic may be used which is produced by kneading a thermoplastic resin together with any one or combination of a metal oxide such as tin oxide or indium oxide, a conductive polymer and a conductive particle such as carbon black and then subjecting the mixture to extrusion molding. Besides, it is possible to obtain an intermediate transfer medium 60 in the form of an endless belt by heating and centrifugally molding a resin solution containing a thermally crosslinkable monomer or oligomer, with the addition of the above-mentioned conductive particle and/or conductive polymer, if necessary.

When the intermediate transfer medium 60 is provided with a surface layer (protective layer 1*d*) as in the photoconductor drum 1, the materials for the surface layer used in the protective layer 1*d* of the photoconductor drum 1, excluding the charge transporting material, may be used after suitably subjected to resistance adjustment with the use of a conductive material.

Next, a toner suitably used in the present embodiment will be explained.

Firstly, a toner used in the present embodiment preferably has an average circularity of 0.93 to 1.00. In the present invention, the value obtained by Equation (1) is defined as the circularity. The circularity indicates the degree of unevenness of a toner particle; when the toner particle is perfectly spherical, the circularity is 1.00; meanwhile, the more complex the surface shape of the toner particle becomes, the smaller the circularity becomes.

Circularity SR=Circumferential length of a circle having the same area as projected particle area/Circumferential length of projected particle image — Equation 1

When the average circularity is in the range of 0.93 to 1.00, the surface of toner particles is smooth, and the area where the toner particles are in contact with one another and the area where the toner particles are in contact with the photoconductor drum surface 1*a* are small, so that excellent transferability can be obtained.

The toner particles do not have angles, so that the torque with which a developer is stirred in a developing unit 5 can be reduced and the driving for stirring can be stabilized; therefore, abnormal images are not formed.

Since the toner particles which form dots do not include angular toner particles, pressure is uniformly applied to the entire toner particles when they are transferred and pressed against a transfer medium, and thus absence of toner particles hardly occurs during the transfer. Since the toner particles are not angular, the toner particles themselves have little abrasive power, thus not damaging or abrading the surface of the image bearing member.

Next, a method of measuring the circularity will be explained.

The circularity can be measured using the flow-type particle image analyzer FPIA-1000 (produced by Toa Medical Electronics Co., Ltd.). Specifically, 0.1 ml to 0.5 ml of a surfactant (preferably alkylbenzene sulfonate) is added as a dispersant into 100 ml to 150 ml of water in a container, from which solid impurities have previously been removed. Then, approximately 0.1 g to 0.5 g of a measurement sample (toner) is added. The suspension in which the sample is dispersed is subjected to dispersing treatment by an ultrasonic dispersing device for approximately 1 min to 3 min, and the concentration of the dispersed solution is adjusted such that the number of particles of the sample is 3,000 per microliter to 10,000 per microliter. Under this condition, the particle shape and particle size of the toner are measured using the analyzer.

In the present embodiment, the toner preferably has a mass average particle diameter D4 of 3 μm to 10 μm. When the mass average particle diameter D4 is in this range, the toner includes particles which are sufficiently small in diameter with respect to fine dots of a latent image, thereby obtaining superior dot reproducibility.

When the mass average particle diameter D4 is less than 3 μm, phenomena of decrease in transfer efficiency and blade cleaning capability easily arise. When the mass average particle diameter D4 is greater than 10 μm, it is difficult to reduce raggedness of lines and letters/characters.

The ratio (D4/D1) of the mass average particle diameter D4 of the toner to a number average particle diameter D1 of the toner is preferably in the range of 1.00 to 1.40. The closer the value of the ratio (D4/D1) is to 1, the sharper the particle size distribution of the toner is.

Thus, when the ratio (D4/D1) is in the range of 1.00 to 1.40, differences in particle diameter of the toner do not cause particles to be unevenly used for image formation, so that the image quality can be excellently stabilized.

Since the particle size distribution of the toner is sharp, the distribution of the frictional charge amount is also sharp, and thus the occurrence of fogging can be reduced.

When the toner has a uniform particle diameter, a latent image is developed such that particles are accurately and neatly arranged on dots of the latent image, and thus superior dot reproducibility can be obtained.

Next, a method of measuring the particle size distribution of toner particles will be explained.

Examples of a measuring device for measuring the particle size distribution of toner particles in accordance with a Coulter counter method include COULTER COUNTER TA-II and COULTER MULTISIZER II (both of which are produced by Coulter Corporation). The following describes the method.

Firstly, 0.1 ml to 5 ml of a surfactant (preferably alkylbenzene sulfonate) is added as a dispersant into 100 ml to 150 ml of an electrolytic aqueous solution. Here, the electrolytic aqueous solution means an approximately 1 mass % NaCl aqueous solution prepared using primary sodium chloride. For the preparation, ISOTON-II (produced by Coulter Corporation) can be used, for example. Then 2 mg to 20 mg of a measurement sample is added. The electrolytic aqueous solution in which the sample is suspended is subjected to dispersing treatment by an ultrasonic dispersing device for approximately 1 min to 3 min, then the volume of the toner or toner particles and the number of the toner particles are measured by the measuring device, using apertures of 100 μm each, and the volume distribution and the number distribution are thus calculated. The mass average particle diameter D4 and the number average particle diameter D1 of the toner can be calculated from these distributions obtained.

As channels, the following 13 channels are used, and particles having diameters which are equal to or greater than 2.00 μm, and less than 40.30 μm are targeted: a channel of 2.00 μm or greater, and less than 2.52 μm; a channel of 2.52 μm or greater, and less than 3.17 μm; a channel of 3.17 μm or greater, and less than 4.00 μm; a channel of 4.00 μm or greater, and less than 5.04 μm; a channel of 5.04 μm or greater, and less than 6.35 μm; a channel of 6.35 μm or greater, and less than 8.00 μm; a channel of 8.00 μm or greater, and less than 10.08 μm; a channel of 10.08 μm or greater, and less than 12.70 μm; a channel of 12.70 μm or greater, and less than 16.00 μm; a channel of 16.00 μm or greater, and less than 20.20 μm; a channel of 20.20 μm or greater, and less than 25.40 μm; a channel of 25.40 μm or greater, and less than 32.00 μm; and a channel of 32.00 μm or greater, and less than 40.30 μm.

For such a substantially spherical toner, it is preferable to use a toner obtained by cross-linking and/or elongating a toner composition including a polyester prepolymer which has a nitrogen atom-containing functional group, a polyester, a colorant and a releasing agent in the presence of fine resin particles in an aqueous medium. The toner produced by the cross-linking and/or elongating reaction can reduce hot offset by hardening the toner surface and thus to suppress smears from being left on a fixing device and appearing on images.

Examples of prepolymers made from modified polyester resins, which can be used for producing toner, include isocyanate group-containing polyester prepolymers (A). Examples of compounds which elongate and/or cross-link with the prepolymers include amines (B). Examples of the isocyanate group-containing polyester prepolymers (A) include a compound obtained by reaction between a polyisocyanate (3) and a polyester which is a polycondensate of a polyol (1) and a polycarboxylic acid (2) and contains an active hydrogen group. Examples of the active hydrogen group of the polyester include hydroxyl groups (for example, alcoholic hydroxyl groups and phenolic hydroxyl groups), amino groups, carboxyl groups and mercapto groups, with preference being given to alcoholic hydroxyl groups.

Examples of the polyol (1) include diols (1-1) and trihydric or higher polyols (1-2), and it is preferable to use any of the diols (1-1) alone, or mixtures each composed of any of the diols (1-1) and a small amount of any of the trihydric or higher polyols (1-2). Examples of the diols (1-1) include alkylene glycols (ethylene glycol, 1,2-propylene glycol, 1,3-propylene glycol, 1,4-butanediol, 1,6-hexanediol, etc.); alkylene ether glycols (diethylene glycol, triethylene glycol, dipropylene glycol, polyethylene glycol, polypropylene glycol, polytetramethylene ether glycol, etc.); alicyclic diols (1,4-cyclohexanedimethanol, hydrogenated bisphenol A, etc.); bisphenols (bisphenol A, bisphenol F, bisphenol S, etc.); alkylene oxide (ethylene oxide, propylene oxide, butylene oxide, etc.) adducts of the alicyclic diols; and alkylene oxide (ethylene oxide, propylene oxide, butylene oxide, etc.) adducts of the bisphenols. Among these, preference is given to alkylene glycols having 2 to 12 carbon atoms, and alkylene oxide adducts of bisphenols, and greater preference is given to alkylene oxide adducts of bisphenols, and combinations of the alkylene oxide adducts of bisphenols and alkylene glycols having 2 to 12 carbon atoms. Examples of the trihydric or higher polyols (1-2) include trihydric to octahydric or higher aliphatic alcohols (glycerin, trimethylolethane, trimethylolpropane, pentaerythritol, sorbitol, etc.); trihydric or higher phenols (trisphenol PA, phenol novolac, cresol novolac, etc.); and alkylene oxide adducts of the trihydric or higher phenols.

Examples of the polycarboxylic acid (2) include dicarboxylic acids (2-1) and trivalent or higher polycarboxylic acids (2-2), and it is preferable to use any of the dicarboxylic acids (2-1) alone, or mixtures each composed of any of the dicarboxylic acids (2-1) and a small amount of any of the trivalent or higher polycarboxylic acids (2-2). Examples of the dicarboxylic acids (2-1) include alkylene dicarboxylic acids (succinic acid, adipic acid, sebacic acid, etc.); alkenylene dicarboxylic acids (maleic acid, fumaric acid, etc.); and aromatic dicarboxylic acids (phthalic acid, isophthalic acid, terephthalic acid, naphthalenedicarboxylic acid, etc.). Among these, preference is given to alkenylene dicarboxylic acids having 4 to 20 carbon atoms and aromatic dicarboxylic acids having 8 to 20 carbon atoms. Examples of the trivalent or higher polycarboxylic acids (2-2) include aromatic polycarboxylic acids (trimellitic acid, pyromellitic acid, etc.) having 9 to 20 carbon atoms. Additionally, the polycarboxylic acid (2) may be selected from acid anhydrides or lower alkyl esters (methyl ester, ethyl ester, isopropyl ester, etc.) of the above-mentioned compounds and reacted with the polyol (1).

As for the proportion of the polyol (1) to the polycarboxylic acid (2), the equivalence ratio [OH]/[COOH] of the hydroxyl group [OH] to the carboxyl group [COOH] is normally in the range of 2/1 to 1/1, preferably in the range of 1.5/1 to 1/1, more preferably in the range of 1.3/1 to 1.02/1.

Examples of the polyisocyanate (3) include aliphatic polyisocyanates (tetramethylene diisocyanate, hexamethylene diisocyanate, 2,6-diisocyanatomethyl caproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); aromatic aliphatic diisocyanates (α,α,α',α'-tetramethylxylylene diisocyanate, etc.); isocyanurates; the polyisocyanates blocked with phenol derivatives, oximes, caprolactam, etc.; and combinations thereof.

As for the proportion of the polyisocyanate (3) to the polyester, the equivalence ratio [NCO]/[OH] of the isocyanate group [NCO] to the hydroxyl group [OH] of the hydroxyl group-containing polyester is normally in the range of 5/1 to 1/1, preferably in the range of 4/1 to 1.2/1, more preferably in the range of 2.5/1 to 1.5/1. When the equivalence ratio [NCO]/[OH] is greater than 5, there is a decrease in low-temperature fixing ability. When the isocyanate group [NCO] is less than 1 in molar ratio, the amount of urea contained in the modified polyester is small, adversely affecting resistance to hot offset. The amount of components of the polyisocyanate (3) contained in the isocyanate-terminated prepolymer (A) is normally 0.5% by mass to 40% by mass, preferably 1% by mass to 30% by mass, more preferably 2% by mass to 20% by mass. When the amount is less than 0.5% by mass, there is a decrease in resistance to hot offset and there is a disadvantage in satisfying both heat-resistant storage ability and low-temperature fixing ability. When the amount is greater than 40% by mass, there is a decrease in low-temperature fixing ability.

The number of isocyanate groups contained per molecule in the isocyanate group-containing prepolymer (A) is normally 1 or more, preferably 1.5 to 3 on average, more preferably 1.8 to 2.5 on average. When the number of the isocyanate groups per molecule is less than 1 on average, the molecular mass of the urea-modified polyester is low, and thus there is a decrease in resistance to hot offset.

Examples of the amines (B) include diamines B1), trivalent or higher polyamines (B2), amino alcohols (B3), amino mercaptans (B4), amino acids (B5), and compounds (B6)

obtained by blocking amino groups of (B1) to (B5). Examples of the diamines (B1) include aromatic diamines such as phenylenediamine, diethyltoluenediamine, 4,4'-diaminodiphenylmethane, etc.; alicyclic diamines such as 4,4'-diamino-3,3'-dimethyldicyclohexylmethane, diaminecyclohexane, isophoronediamine, etc.; and aliphatic diamines such as ethylenediamine, tetramethylenediamine, hexamethylenediamine, etc. Examples of the trivalent or higher polyamines (B2) include diethylenetriamine and triethylenetetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6) obtained by blocking amino groups of (B1) to (B5), include oxazoline compounds and ketimine compounds derived from the amines of (B1) to (B5) and ketones such as acetone, methy ethyl ketone, methyl isobutyl ketone, etc. Among these amines (B), preference is given to the diamines (B1), and mixtures each composed of any of the diamines (B1) and a small amount of any of the trivalent or higher polyamines (B2).

Further, an elongation terminator may be used so as to adjust the molecular mass of the urea-modified polyester, if necessary. Examples of the elongation terminator include monoamines such as diethylamine, dibutylamine, butylamine, laurylamine, etc., and compounds such as ketimine compounds obtained by blocking the monoamines.

As for the proportion of the amine (B), the equivalence ratio [NCO]/[NHx] of the isocyanate group [NCO] in the isocyanate group-containing prepolymer (A) to the amino group [NHx] in the amine (B) is normally in the range of 1/2 to 2/1, preferably in the range of 1.5/1 to 1/1.5, more preferably in the range of 1.2/1 to 1/1.2. When the equivalence ratio [NCO]/[NHx] is greater than 2 or less than 1/2, the molecular mass of the urea-modified polyester (i) is low, and thus there is a decrease in resistance to hot offset. In the present invention, the urea-modified polyester (i) may contain a urethane bond as well as a urea bond. The molar ratio of the amount of the urea bond to the amount of the urethane bond is normally in the range of 100/0 to 10/90, preferably in the range of 80/20 to 20/80, more preferably in the range of 60/40 to 30/70. When the urea bond is less than 10% in molar ratio, there is a decrease in resistance to hot offset.

By the above-mentioned reactions, a modified polyester, particularly the urea-modified polyester (i), used in the toner of the present embodiment can be produced. The urea-modified polyester (i) is produced by a one-shot method or a prepolymer method. The mass average molecular mass of the urea-modified polyester (i) is normally 10,000 or greater, preferably 20,000 to 10,000,000, more preferably 30,000 to 1,000,000. When it is less than 10,000, there is a decrease in resistance to hot offset. The number average molecular mass of the urea-modified polyester is not particularly limited when the after-mentioned unmodified polyester (ii) is additionally used; it may be such a number average molecular mass as helps obtain the above-mentioned mass average molecular mass. When the urea-modified polyester (i) is solely used, its number average molecular mass is normally 20,000 or less, preferably 1,000 to 10,000, more preferably 2,000 to 8,000. When it is greater than 20,000, there is a decrease in low-temperature fixing ability, and in the case of using in a full-color apparatus, there is a decrease in glossiness.

In the present embodiment, instead of solely using the urea-modified polyester (i), an unmodified polyester (ii) may be additionally used as a binder resin component together with the urea-modified polyester (i). The use of the unmodified polyester (ii) together with the urea-modified polyester (i) is preferable to the use of the urea-modified polyester (i) alone because there is an increase in low-temperature fixing ability, and in the case of using in a full-color apparatus, there is an increase in glossiness. Examples of the unmodified polyester (ii) include a polycondensate of a polyol (1) and a polycarboxylic acid (2) similar to the components of the urea-modified polyester (i), and suitable examples thereof are also similar to those suitable for the urea-modified polyester (i). The polyester (ii) does not necessarily have to be an unmodified polyester and may be a polyester modified with a chemical bond other than urea bond, for example urethane bond. It is desirable in terms of low-temperature fixing ability and resistance to hot offset that the urea-modified polyester (i) and the polyester (ii) be compatible with each other at least partially. Accordingly, it is desirable that the urea-modified polyester (i) and the polyester (ii) have similar compositions. When the polyester (ii) is used, the mass ratio of the urea-modified polyester (i) to the polyester (ii) is normally in the range of 5/95 to 80/20, preferably in the range of 5/95 to 30/70, more preferably in the range of 5/95 to 25/75, particularly preferably in the range of 7/93 to 20/80. When the mass ratio of the urea-modified polyester (i) is less than 5%, there is a decrease in resistance to hot offset and there is a disadvantage in satisfying both the heat-resistant storage ability and the low-temperature fixing ability.

The peak molecular mass of the polyester (ii) is normally 1,000 to 30,000, preferably 1,500 to 10,000, more preferably 2,000 to 8,000. When it is less than 1,000, there is a decrease in heat-resistant storage ability. When it is greater than 10,000, there is a decrease in low-temperature fixing ability. The hydroxyl value of the polyester (ii) is preferably 5 or greater, more preferably 10 to 120, particularly preferably 20 to 80. When the hydroxyl value is less than 5, there is a disadvantage in satisfying both the heat-resistant storage ability and the low-temperature fixing ability. The acid value of the polyester (ii) is normally 1 to 30, preferably 5 to 20. With such an acid value, the polyester (ii) tends to be easily negatively charged.

In the present embodiment, the glass transition temperature (Tg) of the binder resin is normally 50° C. to 70° C., preferably 55° C. to 65° C. When it is lower than 50° C., blocking worsens when the toner is stored at a high temperature. When it is higher than 70° C., the low-temperature fixing ability is insufficient. Due to the presence of the urea-modified polyester together with the binder, the dry toner in the present invention tends to be superior in heat-resistant storage ability to known polyester toners even if the dry toner has a low glass transition temperature. As for the storage elastic modulus of the binder resin, the temperature (TG') at which it is 10,000 dyne/cm$^2$, at a measurement frequency of 20 Hz, is normally 100° C. or higher, preferably 110° C. to 200° C. When the temperature is lower than 100° C., there is a decrease in resistance to hot offset. As for the viscosity of the binder resin, the temperature (Tη) at which it is 1,000 P, at a measurement frequency of 20 Hz, is normally 180° C. or lower, preferably 90° C. to 160° C. When the temperature is higher than 180° C., there is a decrease in low-temperature fixing ability. Accordingly, it is desirable that TG' be higher than Tη, in terms of satisfying both low-temperature fixing ability and resistance to hot offset. In other words, the difference (TG'−Tη) between TG' and Tη is preferably 0° C. or greater. It is more preferably 10° C. or greater, particularly preferably 20° C. or greater. The upper limit of the difference between TG' and Tη is not particularly limited. Also, it is desirable that the difference between Tη and Tg be 0° C. to 100° C., more preferably 10° C. to 90° C., particularly preferably 20° C. to 80° C., in terms of satisfying both the heat-resistant storage ability and the low-temperature fixing ability.

The binder resin is produced by the following method or the like. A polyol (1) and a polycarboxylic acid (2) are heated at a temperature of 150° C. to 280° C. in the presence of a known esterification catalyst such as tetrabutoxy titanate or dibutyltin oxide, then water produced is distilled away, with a reduction in pressure if necessary, and a hydroxyl group-containing polyester is thus obtained. Subsequently, the polyester is reacted with a polyisocyanate (3) at a temperature of 40° C. to 140° C. so as to obtain an isocyanate group-containing prepolymer (A). Further, the prepolymer (A) is reacted with an amine (B) at a temperature of 0° C. to 140° C. so as to obtain a urea-modified polyester. When the polyester is reacted with the polyisocyanate (3) and when the prepolymer (A) is reacted with the amine (B), solvent may be used if necessary. Examples of usable solvents include aromatic solvents such as toluene, xylene, etc.; ketones such as acetone, methyl ethyl ketone, methyl isobutyl ketone, etc.; esters such as ethyl acetate, etc.; amides such as dimethylformamide, dimethylacetamide, etc.; and ethers such as tetrahydrofuran, etc., which are inactive to the polyisocyanate (3). In the case where the polyester (ii) which is not modified with a urea bond is additionally used, the polyester (ii) is produced in a manner similar to the production of the hydroxyl group-containing polyester, and the polyester (ii) is dissolved and mixed in a solution of the above-mentioned urea-modified polyester (i) in which reaction has been finished.

Generally, the toner used in the present embodiment can be produced by the following method. However, other methods may be employed instead.

The aqueous medium used in the present embodiment may be composed solely of water or composed of water and a solvent miscible with water. Examples of the solvent miscible with water include alcohols such as methanol, isopropanol, ethylene glycol, etc.; dimethylformamide; tetrahydrofuran; cellusolves such as methyl cellusolve, etc.; and lower ketones such as acetone, methyl ethyl ketone, etc.

Toner particles may be formed in the aqueous medium by reaction between the amine (B) and a dispersion of the isocyanate group-containing prepolymer (A) or by using the urea-modified polyester (i) produced in advance. As a method for stably forming the dispersion of the prepolymer (A) and/or the urea-modified polyester (i) in an aqueous medium, there is, for example, a method of adding a toner material composition which includes the prepolymer (A) or the urea-modified polyester (i) into the aqueous medium and dispersing the composition by shearing force. The prepolymer (A) and other toner compositions (hereinafter referred to as "toner materials") such as a colorant, a colorant master batch, a releasing agent, a charge controlling agent and an unmodified polyester resin may be mixed together when the dispersion element is formed in the aqueous medium; it is, however, more preferred that the toner materials be mixed together in advance, then the mixture is added and dispersed into the aqueous medium. Also in the present invention, the other toner materials such as a colorant, a releasing agent and a charge controlling agent do not necessarily have to be mixed when the particles are formed in the aqueous medium; the other toner materials may be added after the particles have been formed. For instance, articles which do not contain a colorant have been formed, and then a colorant may be added in accordance with a known dyeing method.

The dispersing method is not particularly limited, and known devices may be used in the method. Examples thereof include those using low-speed shearing dispersion, high-speed shearing dispersion, frictional dispersion, high-pressure jet dispersion and ultrasonic dispersion. The high-speed shearing dispersion is preferably used so as to form a dispersion having a particle diameter of 2 μm to 20 μm. In the case where a high-speed shearing dispersing machine is used, the rotational speed is not particularly limited, and it is normally 1000 rpm to 30,000 rpm, preferably 5,000 rpm to 20,000 rpm. The length of time for which the dispersion lasts is not particularly limited, and it is normally 0.1 min to 5 min when a batch method is employed. The temperature for dispersion is normally 0° C. to 150° C. (under pressure), preferably 40° C. to 98° C. High temperatures are preferable in that the dispersion of the prepolymer (A) and/or the urea-modified polyester (i) has a low viscosity so as to be easily dispersed.

The amount of the aqueous medium used is normally 50 parts by mass to 2,000 parts by mass, preferably 100 parts by mass to 1,000 parts by mass, per 100 parts by mass of the toner composition which includes the prepolymer (A) and/or the urea-modified polyester (i). When the amount is less than 50 parts by mass, the toner composition is poorly dispersed, and thus toner particles having a predetermined diameter cannot be obtained. When the amount is greater than 20,000 parts by mass, it is not preferable from an economical point of view. Additionally, a dispersant may be used if necessary. Use of a dispersant is preferable in that the particle size distribution becomes sharper and the dispersion can be stabilized.

As to a process of synthesizing the urea-modified polyester (i) from the prepolymer (A), the amine (B) may be added so as to be reacted therewith, before the toner composition is dispersed in the aqueous medium; alternatively, the amine (B) may be added after the toner composition has been dispersed in the aqueous medium, allowing reaction to occur from particle interfaces. In this case, the urea-modified polyester may be preferentially formed on the surface of the toner produced, and a concentration gradient may be thus provided inside toner particles.

Examples of a dispersant for emulsifying or dispersing in a water-containing liquid an oil phase in which a toner composition is dispersed, include anionic surfactants such as alkylbenzene sulfonates, α-olefin sulfonates and phosphoric acid esters; amine salt cationic surfactants such as alkylamine salts, aminoalcohol fatty acid derivatives, polyamine fatty acid derivatives and imidazoline; quaternary ammonium salt cationic surfactants such as alkyltrimethyl ammonium salts, dialkyl dimethyl ammonium salts, alkyl dimethyl benzyl ammonium salts, pyridinium salts, alkyl isoquinolinium salts and benzetonium chloride; nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N, N-dimethylammoniumbetaine.

A fluoroalkyl group-containing surfactant is effective in extremely small amounts. Suitable examples of fluoroalkyl group-containing anionic surfactants include fluoroalkyl carboxylic acids having 2 to 10 carbon atoms, and metal salts thereof, disodium perfluorooctanesulfonylglutamate, sodium 3-[ω-fluoroalkyl (C6 to C11) oxy]-1-alkyl (C3 to C4)sulfonate, sodium 3-[ω-fluoroalkanoyl (C6 to C8)-N-ethylamino]-1-propanesulfonate, fluoroalkyl (C11 to C20) carboxylic acids and metal salts thereof, perfluoroalkylcarboxylic acids (C7 to C13) and metal salts thereof, perfluoroalkyl (C4 to C12)sulfonic acids and metal salts thereof, perfluorooctanesulfonic acid diethanolamide, N-propyl-N-(2-hydroxyethyl)perfluorooctanesulfonamide, perfluoroalkyl (C6 to C10)sulfonamide propyltrimethylammonium is salts, perfluoroalkyl (C6 to C10)-N-ethylsulfonylglycine salts and monoperfluoroalkyl (C6 to C16)ethyl phosphoric acid esters.

Examples of commercially available products include SURFLON S-111, S-112 and S-113 (produced by Asahi Glass Co., Ltd.); FLUORAD FC-93, FC-95, FC-98 and FC-129 (produced by Sumitomo 3M Limited); UNIDYNE DS-101 and DS-102 (produced by DAIKIN INDUSTRIES, LTD.); MEGAFAC F-110, F-120, F-113, F-191, F-812 and F-833 (produced by Dainippon Ink And Chemicals, Incorporated); EFTOP EF-102, 103, 104, 105, 112, 123A, 123B, 306A, 501, 201 and 204 (produced by Tochem Products Co., Ltd.); and FTERGENT F-100 and F150 (produced by NEOS COMPANY LIMITED).

Examples of cationic surfactants include fluoroalkyl group-containing aliphatic primary, secondary or tertiary amine acids, aliphatic quaternary ammonium salts such as perfluoroalkyl(C6 to C10)sulfonamide propyltrimethylammonium salts, benzalkonium salts, benzetonium chloride, pyridinium salts and imidazolinium salts. Examples of the commercially available products include SURFLON S-121 (produced by Asahi Glass Co., Ltd.), FLUORAD FC-135 (produced by Sumitomo 3M Limited), UNIDYNE DS-202 (produced by DAIKIN INDUSTRIES, LTD.), MEGAFAC F-150 and F-824 (produced by Dainippon Ink And Chemicals, Incorporated), EFTOP EF-132 (produced by Tochem Products Co., Ltd.), and FTERGENT F-300 (produced by NEOS COMPANY LIMITED).

Also, as inorganic compound dispersants sparingly soluble in water, tricalcium phosphate, calcium carbonate, titanium oxide, colloidal silica, hydroxyappetite and the like may be used.

A polymeric protective colloid may be added to stabilize dispersion droplets. Examples thereof include acids such as acrylic acid, methacrylic acid, α-cyanoacrylic acid, α-cyanomethacrylic acid, itaconic acid, crotonic acid, fumaric acid, maleic acid and maleic anhydride; hydroxyl group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide and N-methylolmethacrylamide; vinyl alcohol and ethers of vinyl alcohol such as vinyl methyl ether, vinyl ethyl ether and vinyl propyl ether; esters of carboxyl group-containing compounds and vinyl alcohol such as vinyl acetate, vinyl propionate and vinyl butyrate; acrylamide, methacrylamide, diacetone acrylamide, and methylol compounds thereof, acid chlorides such as acryloyl chloride and methacryloyl chloride; homopolymers and copolymers of vinyl pyridine, vinyl pyrolidone, vinyl imidazole and ethyleneimine, which have nitrogen-atoms or heterocyclic rings; polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester and polyoxyethylene nonyl phenyl ester; and celluloses such as methyl cellulose, hydroxyethyl cellulose and hydroxypropyl cellulose.

In the case where those soluble in acid and/or alkali, such as a calcium phosphate salt, is used as a dispersion stabilizer, a calcium phosphate salt is dissolved in an acid, such as hydrochloric acid, then removed from fine particles, for example by washing with water. Alternatively, the calcium phosphate salt is removed by a process such as decomposition brought about by an enzyme.

In the case where the dispersant is used, the dispersant may remain on the toner particle surface; it is preferable to remove the dispersant by washing after elongation and/or cross-linkage in terms of toner chargeability.

Further, to reduce the viscosity of the toner composition, a solvent may be used in which the urea-modified polyester (i) and/or the prepolymer (A) are/is soluble. Use of the solvent is preferable in that the particle size distribution becomes sharper. The solvent is preferable in terms of easy removal, because it is volatile. Examples of the solvent include toluene, xylene, benzene, carbon tetrachloride, methylene chloride, 1,2-dichloroethane, 1,1,2-trichloroethane, trichloroethylene, chloroform, monochloro benzene, dichloroethylidene, methyl acetate, ethyl acetate, methyl ethyl ketone and methyl isobutyl ketone. These may be used alone or in combination. Among these, preferred are aromatic solvents such as toluene and xylene, and halogenated hydrocarbons such as methylene chloride, 1,2-dichloroethane, chloroform and carbon tetrachloride, with particular preference being given to aromatic solvents such as toluene and xylene. The amount of the solvent used is normally 0 parts by mass to 300 parts by mass, preferably 0 parts by mass to 100 parts by mass, more preferably 25 parts by mass to 70 parts by mass, per 100 parts by mass of the prepolymer (A). In the case where the solvent is used, it is removed by heating under normal or reduced pressure after elongation and/or cross-linkage.

The length of time for which the elongation and/or the cross-linkage lasts is selected according to the reactivity between the isocyanate group structure of the prepolymer (A) and the amine (B) and is normally in the range of 10 min to 40 hr, preferably in the range of 2 hr to 24 hr. The reaction temperature is normally in the range of 0° C. to 150° C., preferably in the range of 40° C. to 98° C. Additionally, a known catalyst may be used if necessary. Specific examples thereof include dibutyltin laurate and dioctyltin laurate.

To remove an organic solvent from the emulsified dispersion obtained, a method can be employed in which the entire system is gradually increased in temperature and the organic solvent in droplets is completely removed by evaporation. Alternatively, by spraying the emulsified dispersion into a dry atmosphere and completely removing a water-insoluble organic solvent from droplets, fine toner particles can be formed, and also, an aqueous dispersant can be removed by evaporation. Generally, examples of the dry atmosphere into which the emulsified dispersion is sprayed include gases such as air, nitrogen, carbonic acid gas and combustion gas which have been heated, especially flow of gasses heated to a temperature higher than or equal to the boiling point of the solvent used that has the highest boiling point. A dry atmosphere of highly desired quality can be obtained by a short-time process with a spray dryer, a belt dryer, a rotary kiln or the like.

In the case where the dispersion has a wide particle size distribution at the time of emulsification and dispersion, and washing and drying processes are carried out with the particle size distribution kept unchanged, it is possible to adjust the particle size distribution such that particles are classified according to a desired particle size distribution. As to the classification, fine particles can be removed by a cyclone separator, a decanter, a centrifuge, etc. in liquid. The classification may be carried out after particles have been obtained as powder through drying; nevertheless, it is desirable in terms of efficiency that the classification be carried out in liquid. Unnecessary fine or coarse particles produced may be returned to a kneading process again so as to be used for formation of particles. In this case, the fine or coarse particles may be in a wet state.

It is desirable that the dispersant used be removed from the obtained dispersion solution as much as possible and at the same time as the classification.

By mixing the obtained dried toner powder with different particles such as releasing agent fine particles, charge controlling fine particles, fluidizer fine particles and colorant fine particles and mechanically impacting the mixed powder, the different particles are fixed to and fused with the particle surface and thus it is possible to prevent detachment of the different particles from the surface of the composite particles obtained.

As specific method of performing the foregoing, there are, for example, a method of impacting the mixture, using a blade which rotates at high speed, and a method of pouring the mixture into a high-speed gas flow, accelerating the speed of the mixture and allowing particles to collide with one another or composite particles to collide with a certain plate. Examples of apparatuses for performing the foregoing include apparatuses in which the pulverization air pressure is reduced, made by modifying I-TYPE MILL (produced by Nippon Pneumatic Mfg. Co., Ltd.) and ANGMILL (produced by Hosokawa Micron Group); HYBRIDIZATION SYSTEM (produced by NARA MACHINERY CO., LTD.); KRYPTRON SYSTEM (produced by Kawasaki Heavy Industries, Ltd.); and automatic mortars.

Examples of the colorant used for the toner include pigments and dyes conventionally used as colorants for toners. Specific examples thereof include carbon black, lamp black, iron black, ultramarine, nigrosine dyes, aniline blue, phthalocyanine blue, phthalocyanine green, Hansa Yellow G, Rhodamine 6C Lake, chalco oil blue, chrome yellow, quinacridone red, benzidine yellow and rose bengal. These may be used alone or in combination.

Further, if necessary, magnetic components may be included alone or in combination in toner particles in order for the toner particles themselves to have magnetic properties. Examples of the magnetic components include iron oxides such as ferrite, magnetite and maghemite, metals such as iron, cobalt and nickel, and alloys composed of these and other metals. Also, these components may be used or used together as colorant components.

Also, the number average particle diameter of the colorant in the toner used in the present embodiment is preferably 0.5 μm or less, more preferably 0.4 μm or less, even more preferably 0.3 μm or less.

When the number average particle diameter of the colorant in the toner is greater than 0.5 μm, the dispersibility of the pigment is insufficient, and thus favorable transparency cannot be obtained in some cases. When the colorant has a minute particle diameter of less than 0.1 μm, it is far smaller than the half wavelength of visible light; thus, it is thought that the colorant does not have an adverse effect on light-reflecting and -absorbing properties. Therefore, colorant particles which are less than 0.1 μm in diameter contribute to favorable color reproducibility and transparency of an OHP sheet with a fixed image. Meanwhile, when there are many colorant particles which are greater than 0.5 μm in diameter, transmission of incident light is disturbed and/or the incident light is scattered, and thus a projected image on an OHP sheet tends to decrease in brightness and vividness.

Moreover, the presence of many colorant particles which are greater than 0.5 μm in diameter is not preferable because the colorant particles easily detach from the toner particle surface, causing problems such as fogging, smearing of the drum and cleaning failure. It should be particularly noted that colorant particles which are greater than 0.7 μm in diameter preferably occupy 10% by number or less, more preferably 5% by number or less, of all colorant particles.

By kneading the colorant together with part or all of a binder resin in advance with the addition of a wetting liquid, the colorant and the binder resin are sufficiently attached to each other at an early stage, the colorant is effectively dispersed in toner particles in a subsequent toner production process, the dispersed particle diameter of the colorant becomes small, and thus more excellent transparency can be obtained. For the binder resin kneaded together with the colorant in advance, any of the resins shown above as examples of binder resins for the toner can be used without the need to change it, but the binder resin is not limited thereto.

As a specific method of kneading a mixture of the colorant and the binder resin in advance with the addition of the wetting liquid, there is, for example, a method in which the colorant, the binder resin and the wetting liquid are mixed together using a blender such as a HENSCHEL MIXER, then the obtained mixture is kneaded at a temperature lower than the melting temperature of the binder resin, using a kneading machine such as a two-roll machine or three-roll machine, and a sample is thus obtained.

For the wetting liquid, those commonly used may be used, considering the solubility of the binder resin and the wettability thereof with the colorant; water and organic solvents such as acetone, toluene and butanone are preferable in terms of the colorant's dispersibility. Among them, water is particularly preferably used in view of care for the environment and maintenance of the colorant's dispersion stability in the subsequent toner production process.

With the use of this production method, not only colorant particles contained in the obtained toner are small in diameter, but also the particles are in a highly uniform dispersed state, so that the color reproducibility of an image projected by an OHP can be further improved.

Additionally, as long as the structure of the present embodiment is employed, a releasing agent typified by wax may be contained along with the binder resin and the colorant in the toner.

As the releasing agent, a known releasing agent may be used, and examples thereof include polyolefin waxes such as polyethylene wax, polypropylene wax, etc., long-chain hydrocarbons such as paraffin wax, Sasolwax, etc., and carbonyl group-containing waxes.

Among these, carbonyl group-containing waxes are preferable. Examples thereof include polyalkanoic acid esters such as carnauba wax, montan wax, trimethylolpropane tribehenate, pentaerythritol tetrabehenate, pentaerythritol diacetate dibehenate, glycerin tribehenate, 1,18-octadecanediol distearate, etc.; polyalkanol esters such as tristearyl trimellitate, distearyl maleate, etc; polyalkanoic acid amides such as ethylenediamine dibehenyl amide, etc.; polyalkylamides such as trimellitic acid tristearyl amide, etc.; and dialkyl ketones such as distearyl ketone, etc.

Among these carbonyl group-containing waxes, preference is given to polyalkanoic acid esters. The melting point of the releasing agent is normally 40° C. to 160° C., preferably 50° C. to 120° C., more preferably 60° C. to 90° C. Waxes having a melting point of lower than 40° C. adversely affect heat-resistant storage ability, and waxes having a melting point of higher than 160° C. are likely to cause cold offset when toner is fixed at a low temperature. The melt viscosity of each wax is preferably 5 cps to 1,000 cps, more preferably 10 cps to 100 cps, when measured at a temperature higher than the melting point by 20° C. Waxes having a melt viscosity higher than 1,000 cps are not much effective in improving low-temperature fixing ability and resistance to hot offset. The amount of wax contained in the toner is normally 0% by mass to 40% by mass, preferably 3% by mass to 30% by mass.

Additionally, to adjust the charged amount of the toner and allow toner particles to rise quickly upon charging, a charge controlling agent may be contained in the toner if necessary. Here, when a colored material is used as the charge controlling agent, there is a change in color, so that use of a material which is colorless or whitish is preferable.

As the charge controlling agent, any conventionally known charge controlling agent may be used. Examples thereof include triphenylmethane dyes, molybdic acid chelate pigments, rhodamine dyes, alkoxy amines, quaternary ammonium salts (including fluorine-modified quaternary ammonium salts), alkylamides, phosphorus and compounds thereof, tungsten and compounds thereof, fluorine activators, metal salts of salicylic acid and metal salts of salicylic acid derivatives. Specific examples thereof include BONTRON P-51 as a quaternary ammonium salt, E-82 as an oxynaphthoic acid metal complex, E-84 as a salicylic acid metal complex, and E-89 as a phenolic condensate (which are produced by Orient Chemical Industries); TP-302 and TP-415 as quaternary ammonium salt molybdenum complexes (which are produced by Hodogaya Chemical Industries); COPY CHARGE PSY VP2038 as a quaternary ammonium salt, COPY BLUE PR as a triphenylmethane derivative, and COPY CHARGE NEG VP2036 and COPY CHARGE NX VP434 as quaternary ammonium salts (which are produced by Hoechst); LRA-901, and LR-147 as a boron complex (which are produced by Japan Carlit Co., Ltd.); quinacridone, azo pigments; and polymeric compounds containing functional groups such as sulfonic acid group, carboxyl group and quaternary ammonium salt.

In the present embodiment, the amount of the charge controlling agent used is decided according to the type of the binder resin, the presence or absence of an additive used if necessary, and the toner production method including the dispersing method and so not unequivocally limited; however, the amount is in the range of 0.1 parts by mass to 10 parts by mass, preferably in the range of 0.2 parts by mass to 5 parts by mass, per 100 parts by mass of the binder resin. When the amount is greater than 10 parts by mass per 100 parts by mass of the binder resin, the chargeability of the toner is so great that effects of the main charge controlling agent are reduced, and there is an increase in electrostatic suction toward a developing roller, causing a decrease in the fluidity of a developer and a decrease in image density. Such a charge controlling agent may be dissolved and dispersed in the toner after melted and kneaded together with a master batch and a resin, or may be directly added into an organic solvent when dissolved and dispersed therein, or may be fixed on the toner particle surface after the formation of toner particles.

When the toner composition is dispersed in the aqueous medium in the toner production process, fine resin particles mainly for stabilizing the dispersion may be added.

For the fine resin particles, any resin may be used as long as it can form an aqueous dispersion. The resin may be a thermoplastic resin or a thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. For the fine resin particles, any two or more of these resins may be used in combination. Among these resins, preference is given to vinyl resins, polyurethane resins, epoxy resins, polyester resins, and combinations thereof because an aqueous dispersion of fine spherical resin particles can be easily obtained.

As the vinyl resins, polymers each produced by homopolymerizing or copolymerizing a vinyl monomer are used. Examples thereof include, but are not limited to, styrene-(meth)acrylate copolymers, styrene-butadiene copolymers, (meth)acrylic acid-acrylate copolymers, styrene-acrylonitrile copolymers, styrene-maleic anhydride copolymers and styrene-(meth)acrylate copolymers.

Further, fine inorganic particles can be preferably used as an external additive to support the fluidity, developing ability and chargeability of toner particles.

The fine inorganic particles preferably have a primary particle diameter of 0.005 μm to 2 μm each, more preferably 0.005 μm to 0.5 μm each. Also, the fine inorganic particles preferably have a BET specific surface area of 20 $m^2/g$ to 500 $m^2/g$. The fine inorganic particles used preferably occupy 0.01% by mass to 5% by mass, more preferably 0.01% by mass to 2.0% by mass, of the toner. Specific examples of the fine inorganic particles include silica, alumina, titanium oxide, barium titanate, magnesium titanate, calcium titanate, strontium titanate, zinc oxide, tin oxide, silica sand, clay, mica, wollastonite, diatom earth, chrome oxide, cerium oxide, red ochre, antimony trioxide, magnesium oxide, zirconium oxide, barium sulfate, barium carbonate, calcium carbonate, silicon carbide and silicon nitride.

Moreover, examples thereof include fine polymer particles exemplified by polymer particles of thermosetting resins, polycondensates such as nylons, benzoguanamine and silicones, acrylic acid ester copolymers, methacrylic acid ester copolymers and polystyrene obtained by soap-free emulsion polymerization, suspension polymerization or dispersion polymerization.

With the use of such additive, i.e. fluidizer, the toner particles can be surface treated so as to increase their hydrophobicity, thereby preventing a decrease in the fluidity and chargeability of the toner particles even at high humidity. Suitable examples of surface-treating agents include silane coupling agents, silylating agents, fluorinated alkyl group-containing silane coupling agents, organic titanate coupling agents, aluminum coupling agents, silicone oils and modified silicone oils.

Examples of a cleanability enhancer for removing a developer which remains on the photoconductor drum 1 or a primary transfer medium, i.e. the intermediate transfer medium 60, after image transfer, include fatty acid metal salts such as zinc stearate, calcium stearate and stearic acid; and fine polymer particles produced by soap-free emulsion polymerization or the like, such as fine polymethyl methacrylate particles and fine polystyrene particles. The fine polymer particles have a relatively narrow particle size distribution, and those which are 0.01 μm to 1 μm in volume average particle diameter are preferable.

By the use of such toner a high-quality toner image excellent in developing stability can be formed, as described above. However, toner particles, which have not been transferred by the transfer roller 6 onto the transfer medium P or the intermediate transfer medium 60, and remain on the photoconductor drum 1, may be hard to be removed by the cleaning unit 4 and possibly pass through between the photoconductor drum 1 and the cleaning unit 4, because of fineness and excellent transferability of the toner particles. To remove the toner particles completely from the photoconductor drum 1, it is necessary to press a toner removing member such as the cleaning blade 41 against the photoconductor drum 1 with strong force. Such a load not only shortens the lifetime of the photoconductor drum 1 and the cleaning unit 4, but also contributes to consumption of extra energy.

In the case where the load on the image bearing member (the photoconductor drum 1 and the intermediate transfer medium 60) is reduced, the toner particles and carrier particles having a small particle diameter on the image bearing member are not sufficiently removed. Thus, these particles do damage to the surface of the image bearing member when passing through the cleaning unit 4, causing variation in the performance of the image forming apparatus 100.

As described above, since the image forming apparatus 100 of the present embodiment has wide acceptable ranges with respect to variation in the state of the image bearing member surface, especially with respect to the existence of low-resistance site, and has a structure in which variation in charging performance to the image bearing member is highly reduced. Therefore, the image forming apparatus and the above-mentioned toner are used together so as to obtain significantly high quality images in a stable manner for a long period of time.

Moreover, the image forming apparatus 100 of the present embodiment can be used with a pulverized toner having an indefinite particle shape as well as with the above-mentioned toner suitable for obtaining high-quality images, and the lifetime of the apparatus can be greatly lengthened.

As the material for such a pulverized toner, any material usually used for electrophotographic toner can be used without any limitation in particular.

Examples of binder resins commonly used for the toner include, but are not limited to, homopolymers of styrene and its substitution polymers, such as polystyrene, poly-p-chlorostyrene and polyvinyl toluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chlormethacrylate copolymers, styrene-acrylonitrile copolymers, styrene-vinyl methyl ketone copolymers, styrene-butadiene copolymers, styrene-isoprene copolymers and styrene-maleic acid copolymers; homopolymers and copolymers of acrylic acid esters, such as polymethyl acrylate, polybutyl acrylate, polymethyl methacrylate and polybutyl methacrylate; polyvinyl derivatives such as polyvinyl chloride and polyvinyl acetate; polyester polymers, polyurethane polymers, polyamide polymers, polyimide polymers, polyol polymers, epoxy polymers, terpene polymers, aliphatic or alicyclic hydrocarbon resins and aromatic petroleum resins. These may be used alone or in combination. It is more preferable that the binder resin be at least one selected from the group consisting of styrene-acrylic copolymer resins, polyester resins and polyol resins in terms of electrical property, cost, and the like. The polyester resins and/or polyol resins is even more preferably used because of their excellent toner-fixing properties.

Additionally, for the above-mentioned reason, resin component(s) contained in a coating layer in the photoconductor, which is/are the same as the resin component used for the binder resin of the toner, is preferably at least one selected from linear polyester resin compositions, linear polyol resin compositions, linear styrene-acrylic resin compositions, and cross-linked products thereof.

As to the pulverized toner, for example, the resin component is mixed with the above-mentioned colorant component, wax component and charge controlling component in advance if necessary, then they are kneaded at a temperature lower than or equal to a temperature in the vicinity of the melting temperature of the resin component, and then the mixture is cooled and then subjected to a pulverization and classification process, thereby producing the toner; additionally, the above-mentioned externally added component may be suitably added and mixed therewith if necessary.

EXAMPLES

Hereinafter, Examples of the present invention will be explained. However, Examples are not to be construed as limiting the invention in any way The mixing conditions of image-bearing member protecting agents of Examples 1 to 16 are shown in Tables 3 to 5, and those of Comparative Examples 1 to 7 are shown in Tables 1 to 2. The image production section of a multi-functional printer IMAGIO MP C4500 (produced by Ricoh Company, Ltd.) was supplied with each of the image-bearing member protecting agents 21 containing fatty acid metal salt of Examples and Comparative Examples. A test was carried out in which images were continuously formed on 10,000 sheets of A4 size paper with an image area ratio of 5%, so as to evaluate smearing of a charging member, i.e. charging roller 3, toner leakage, i.e. toner passing through the cleaning blade, and protecting capability of the photoconductor drum 1.

Smearing on a charging member, i.e. charging roller 3 was evaluated based on the following evaluation criteria:

A: The charging member was hardly smeared.

B: The charging member was somewhat smeared but it did not affect images at normal temperature.

C: The charging member was smeared to such an extent that images were affected at low temperatures.

D: Abnormal images were formed at an early stage.

The toner leakage, i.e. cleanability was evaluated based on the following evaluation criteria:

A: Toner hardly passed through the blade.

B: Toner somewhat passed through but abnormal images were not formed.

C: Toner often passed through the blade and abnormal images were formed in some cases.

D: Abnormal images were frequently formed.

The protecting capability of the photoconductor drum 1 was evaluated based on the following evaluation criteria:

A: Abrasion of the photoconductor and filming hardly occurred.

B: Filming slightly occurred but it was acceptable.

C: Abnormal images were formed over time.

D: Abnormal images were formed at an early stage.

The evaluation results of Examples 1 to 16 are shown in Table 7, and those of Comparative Examples 1 to 7 are shown in Table 6.

Comparative Example 1

Only one type of fatty acid metal salt, zinc stearate, was used as the image-bearing member protecting agent.

Comparative Examples 2 and 3

A mixture of two types of fatty acid metal salts, either zinc stearate and calcium stearate, or zinc stearate and zinc laurate, was used as the image-bearing member protecting agent.

Comparative Examples 4 and 5

A mixture of boron nitride having an oxygen content of less than 0.4% by mass with fatty acid metal salt, zinc stearate, was used as the image-bearing member protecting agent.

Comparative Examples 6 and 7

A mixture of boron nitride having an oxygen content of 4.5% by mass or more with fatty acid metal salt, zinc stearate, was used as the image-bearing member protecting agent.

Examples 1 and 2

A mixture of boron nitride having an oxygen content of 0.4% by mass to 4.5% by mass with fatty acid metal salt, either calcium stearate or zinc laurate, was used as the image-bearing member protecting agent.

Examples 3 to 16

A mixture of boron nitride having an oxygen content of 0.4% by mass to 4.5% by mass with fatty acid metal salt, zinc stearate, was used as the image-bearing member protecting agent. Particularly, in Examples 3 to 7 and Comparative Examples 11 to 16, the amount of the boron nitride having an oxygen content of 0.4% by mass to 4.5% by mass, which was added in fatty acid metal salt, zinc stearate, was changed.

TABLE 1

| Material (manufacturer) | oxygen content (% by mass) | Comp. Ex. 1 | Comp. Ex. 2 | Comp. Ex. 3 |
|---|---|---|---|---|
| zinc stearate (Wako Pure Chemical Industries, Ltd.) | — | 100% | 90% | 90% |
| calcium stearate (Wako Pure Chemical Industries, Ltd.) | — | — | 10% | — |
| zinc laurate (Wako Pure Chemical Industries, Ltd.) | — | — | — | 10% |
| boron nitride (SGP, DENKI KAGAKU KOGYO KABUSHIKI KAISHA) | 0.3 | — | — | — |
| boron nitride (MGP, DENKI KAGAKU KOGYO KABUSHIKI KAISHA) | 0.3 | — | — | — |
| boron nitride (PCT F5, Saint-Gobain K.K.) | 0.5 | — | — | — |
| boron nitride (GP, DENKI KAGAKU KOGYO KABUSHIKI KAISHA) | 0.8 | — | — | — |
| boron nitride (NX5, Momentive Performance Materials Inc.) | 1.25 | — | — | — |
| boron nitride (NX10, Momentive Performance Materials Inc.) | 1.2 | — | — | — |
| boron nitride (HCV, Momentive Performance Materials Inc.) | 2.7 | — | — | — |
| boron nitride (FS-1, MIZUSHIMA FERROALLOY CO., LTD.) | 4 | — | — | — |
| boron nitride (PCTUFB, Saint-Gobain K.K.) | 5 | — | — | — |
| boron nitride (NX9, Momentive Performance Materials Inc.) | 12 | — | — | — |

TABLE 2

| Material (manufacturer) | oxygen content (% by mass) | Comp. Ex. 4 | Comp. Ex. 5 | Comp. Ex. 6 | Comp. Ex. 7 |
|---|---|---|---|---|---|
| zinc stearate (Wako Pure Chemical Industries, Ltd.) | — | 80% | 80% | 80% | 80% |
| calcium stearate (Wako Pure Chemical Industries, Ltd.) | — | — | — | — | — |
| zinc laurate (Wako Pure Chemical Industries, Ltd.) | — | — | — | — | — |
| boron nitride (SGP, DENKI KAGAKU KOGYO KABUSHIKI KAISHA) | 0.3 | 20% | — | — | — |
| boron nitride (MGP, DENKI KAGAKU KOGYO KABUSHIKI KAISHA) | 0.3 | — | 20% | — | — |
| boron nitride (PCT F5, Saint-Gobain K.K.) | 0.5 | — | — | — | — |
| boron nitride (GP, DENKI KAGAKU KOGYO KABUSHIKI KAISHA) | 0.8 | — | — | — | — |
| boron nitride (NX5, Momentive Performance Materials Inc.) | 1.25 | — | — | — | — |
| boron nitride (NX10, Momentive Performance Materials Inc.) | 1.2 | — | — | — | — |
| boron nitride (HCV, Momentive Performance Materials Inc.) | 2.7 | — | — | — | — |
| boron nitride (FS-1, MIZUSHIMA FERROALLOY CO., LTD.) | 4 | — | — | — | — |
| boron nitride (PCTUFB, Saint-Gobain K.K.) | 5 | — | — | 20% | — |
| boron nitride (NX9, Momentive Performance Materials Inc.) | 12 | — | — | — | 20% |

TABLE 3

| Material (manufacturer) | oxygen content (% by mass) | Ex. 1 | Ex. 2 | Ex. 3 | Ex. 4 | Ex. 5 |
|---|---|---|---|---|---|---|
| zinc stearate (Wako Pure Chemical Industries, Ltd.) | — | — | — | 80% | 95% | 90% |
| calcium stearate (Wako Pure Chemical Industries, Ltd.) | — | 80% | — | — | — | — |
| zinc laurate (Wako Pure Chemical Industries, Ltd.) | — | — | 80% | — | — | — |
| boron nitride (SGP, DENKI KAGAKU KOGYO KABUSHIKI KAISHA) | 0.3 | — | — | — | — | — |
| boron nitride (MGP, DENKI KAGAKU KOGYO KABUSHIKI KAISHA) | 0.3 | — | — | — | — | — |
| boron nitride (PCT F5, Saint-Gobain K.K.) | 0.5 | — | — | — | — | — |
| boron nitride (GP, DENKI KAGAKU KOGYO KABUSHIKI KAISHA) | 0.8 | — | — | — | — | — |
| boron nitride (NX5, Momentive Performance Materials Inc.) | 1.25 | 20% | 20% | 20% | 5% | 10% |
| boron nitride (NX10, Momentive Performance Materials Inc.) | 1.2 | — | — | — | — | — |
| boron nitride (HCV, Momentive Performance Materials Inc.) | 2.7 | — | — | — | — | — |
| boron nitride (FS-1, MIZUSHIMA FERROALLOY CO., LTD.) | 4 | — | — | — | — | — |
| boron nitride (PCTUFB, Saint-Gobain K.K.) | 5 | — | — | — | — | — |
| boron nitride (NX9, Momentive Performance Materials Inc.) | 12 | — | — | — | — | — |

TABLE 4

| Material (manufacturer) | oxygen content (% by mass) | Ex. 6 | Ex. 7 | Ex. 8 | Ex. 9 | Ex. 10 |
|---|---|---|---|---|---|---|
| zinc stearate (Wako Pure Chemical Industries, Ltd.) | — | 50% | 20% | 80% | 80% | 80% |
| calcium stearate (Wako Pure Chemical Industries, Ltd.) | — | — | — | — | — | — |
| zinc laurate (Wako Pure Chemical Industries, Ltd.) | — | — | — | — | — | — |
| boron nitride (SGP, DENKI KAGAKU KOGYO KABUSHIKI KAISHIA) | 0.3 | — | — | — | — | — |
| boron nitride (MGP, DENKI KAGAKU KOGYO KABUSHIKI KAISHA) | 0.3 | — | — | — | — | — |
| boron nitride (PCT F5, Saint-Gobain K.K.) | 0.5 | — | — | 20% | — | — |
| boron nitride (GP, DENKI KAGAKU KOGYO KABUSHIKI KAISHA) | 0.8 | — | — | — | 20% | — |
| boron nitride (NX5, Momentive Performance Materials Inc.) | 1.25 | 50% | 80% | — | — | — |
| boron nitride (NX10, Momentive Performance Materials Inc.) | 1.2 | — | — | — | — | 20% |
| boron nitride (HCV, Momentive Performance Materials Inc.) | 2.7 | — | — | — | — | — |
| boron nitride (FS-1, MIZUSHIMA FERROALLOY CO., LTD.) | 4 | — | — | — | — | — |
| boron nitride (PCTUFB, Saint-Gobain K.K.) | 5 | — | — | — | — | — |
| boron nitride (NX9, Momentive Performance Materials Inc.) | 12 | — | — | — | — | — |

TABLE 5

| Material (manufacturer) | oxygen content (% by mass) | Ex. 11 | Ex. 12 | Ex. 13 | Ex. 14 | Ex. 15 | Ex. 16 |
|---|---|---|---|---|---|---|---|
| zinc stearate (Wako Pure Chemical Industries, Ltd.) | — | 80% | 95% | 90% | 50% | 20% | 80% |
| calcium stearate (Wako Pure Chemical Industries, Ltd.) | — | — | — | — | — | — | |
| zinc laurate (Wako Pure Chemical Industries, Ltd.) | — | — | — | — | — | — | |
| boron nitride (SGP, DENKI KAGAKU KOGYO KABUSHIKI KAISHA) | 0.3 | — | — | — | — | — | |
| boron nitride (MGP, DENKI KAGAKU KOGYO KABUSHIKI KAISHA) | 0.3 | — | — | — | — | — | |
| boron nitride (PCT F5, Saint-Gobain K.K.) | 0.5 | — | — | — | — | — | |
| boron nitride (GP, DENKI KAGAKU KOGYO KABUSHIKI KAISHA) | 0.8 | — | — | — | — | — | |
| boron nitride (NX5, Momentive Performance Materials Inc.) | 1.25 | — | — | — | — | — | |
| boron nitride (NX10, Momentive Performance Materials Inc.) | 1.2 | — | — | — | — | — | |
| boron nitride (HCV, Momentive Performance Materials Inc.) | 2.7 | 20% | 5% | 10% | 50% | 80% | |
| boron nitride (FS-1, MIZUSHIMA FERROALLOY CO., LTD.) | 4 | — | — | — | — | — | 20% |
| boron nitride (PCTUFB, Saint-Gobain K.K.) | 5 | — | — | — | — | — | |
| boron nitride (NX9, Momentive Performance Materials Inc.) | 12 | — | — | — | — | — | |

TABLE 6

| | cleanability | smearing of the charging member | protecting capability of the photoconductor drum |
|---|---|---|---|
| Comp. Ex. 1 | C | D | A |
| Comp. Ex. 2 | D | C | B |
| Comp. Ex. 3 | D | C | B |
| Comp. Ex. 4 | A | A | D |
| Comp. Ex. 5 | A | A | D |
| Comp. Ex. 6 | C | C | A |
| Comp. Ex. 7 | C | C | A |

TABLE 7

| | cleanability | smearing of the charging member | protecting capability of the photoconductor drum |
|---|---|---|---|
| Ex. 1 | B | B | B |
| Ex. 2 | B | A | B |
| Ex. 3 | A | A | A |
| Ex. 4 | B | A | A |
| Ex. 5 | A | A | A |
| Ex. 6 | A | A | A |
| Ex. 7 | A | A | B |
| Ex. 8 | A | A | B |
| Ex. 9 | A | A | B |
| Ex. 10 | A | A | A |
| Ex. 11 | A | A | A |
| Ex. 12 | B | A | B |
| Ex. 13 | A | A | A |
| Ex. 14 | A | A | A |

TABLE 7-continued

| | cleanability | smearing of the charging member | protecting capability of the photoconductor drum |
|---|---|---|---|
| Ex. 15 | A | A | B |
| Ex. 16 | B | A | A |

It is understood that the image-bearing member protecting agent of the present embodiment can prevent the toner leakage, smearing on the charging member, and filming on the image bearing member for the following reasons.

The image-bearing member protecting agent 21 is applied to an electrophotographic image bearing member in order to protect the image bearing member from hazards upon charging and cleaning. However, the fatty acid metal salt generally used for the image-bearing member protecting agent is decreased in the lubricating property, due to the influence of charging. Thus toner passes through a contact portion between a cleaning blade 41 and the image bearing member, causing cleaning failure. Moreover, the fatty acid metal salt itself spatters and adheres to the charging member, i.e. charging roller 3, thus smearing the charging member.

It should be noted that boron nitride is added to assist the lubricating property and prevent the toner leakage. Further, improvement in the lubricating property enables to reduce the leakage amount of the fatty acid metal salt and the amount of the fatty acid metal salt spattering to the charging member.

As in Comparative Example 1, the use of one type of fatty acid metal salt alone causes the cleaning failure and smearing on the charging member. As in Comparative Examples 2 and 3, the use of a plurality of types of fatty acid metal salts is inferior to the use of one type of fatty acid metal salt alone in cleanability. As in Comparative Examples 4 and 5, when boron nitride having an oxygen content of less than 0.4% by mass is mixed with the fatty acid metal salt, the cleanability is significantly improved and smearing on the charging member is significantly lessen, but the protecting capability on the photoconductor drum surface 1*a* of the photoconductor drum 1 is outstandingly decreased.

It is considered that as the purity of the boron nitride is so high and the lubricating properties are excessively high, the boron nitride is hardly removed by the cleaning blade 41 and is laid over the photoconductor drum 1.

On the other hand, as in Comparative Examples 6 and 7, when the boron nitride having an oxygen content of more than 4.5% by mass is mixed with the fatty acid metal salt, the cleanability and smearing on the charging member are less affected. It is considered that the boron nitride contained so large amount of impurities that the lubricating property can not be exhibited.

On the other hand, as in Examples, when the mixture of the boron nitride having an oxygen content of 0.4% by mass to 4.5% by mass with the fatty acid metal salt is used as the image-bearing member protecting agent 21, the cleanability is improved and smearing on the charging member is lessen, and in addition, the protecting capability on the photoconductor is improved. It is considered that the boron nitride having the oxygen content of 0.4% by mass to 4.5% by mass exhibits sufficient effect in excellent cleanability and less smearing of the charging member, and does not have excessively high purity, so that it is hard to be laid over the photoconductor drum 1, and that the boron nitride does not have excessively low purity, so that it is easily removed by the cleaning blade 41.

As in Examples 3 to 7 and 11 to 16, the image-bearing member protecting agent is used without causing problems, in the case where the amount of the boron nitride is added to the fatty acid metal salt with a range from 5% by mass to 80% by mass, with preference being given to 10% by mass to 50% by mass. The oxygen content of the present embodiment is obtained in such a manner that the oxygen content in the boron nitride is measured by TC-436 (produced by LECO corporation), and indicated in "% by mass".

When Examples 1 and 2 are compared with Example 3, zinc stearate is superior to other fatty acid metal salts in the cleanability and the protecting capability on the photoconductor. Moreover, stearic acid is cheapest among higher fatty acids, a salt of zinc stearate is highly stable and excellent in hydrophobicity.

Since the image-bearing member protecting agent 21 of the present embodiment attaches to the photoconductor drum surface 1*a* so as to form a layer, thereby exhibiting protecting effects, the agent is relatively easily subjected to plastic deformation. Therefore, in the case where a protective layer 1*d* is formed by directly pressing a mass of components of the image-bearing member protecting agent against the photoconductor drum surface 1*a*, the image-bearing member protecting agent 21 is excessively supplied to the photoconductor drum surface 1*a*, causing less efficient formation of the protective layer, and the protective layer 1*d* is formed as a multilayer, causing disturbance of transmission of light in an exposing step in the latent electrostatic image formation. Thus, the types of the image-bearing member protecting agents 21 to be used are limited. By contrast, by constituting the protective layer forming device 2 as described above and providing the protecting agent supply member 22 between the image-bearing member protecting agent 21 and the photoconductor drum 1, the photoconductor drum surface 1*a* can be uniformly supplied with the image-bearing member protecting agent 21 even when the agent is soft.

Additionally, as shown in FIG. 1, when a blade 241, which is a protective layer forming member for pressing the image-bearing member protecting agent 21 so as to form a layer, is provided in a protective layer forming device 2, the blade 241 may also be served as a cleaning member. In order to form a protective layer 1*d* more surely, a cleaning blade 41 is provided in addition to the blade 241. The positional relationship thereof are as follows: the cleaning blade 41 of the cleaning unit 4 is located on a downstream side of the transfer roller 6 as a transfer unit and on an upstream side of the protective layer forming device 2, specifically, a region which is supplied with the protecting agent by the protecting agent supply member 22, with respect to the rotational direction of the photoconductor drum 1. The cleaning blade 41 is preferably configured to be rubbed against the photoconductor drum surface 1*a* so as to remove a residue, which mainly contains a toner, remaining thereon, thereby preventing the residue from being mixed in the protective layer 1*d*.

As an embodiment shown in FIG. 1, by providing the protective layer forming device 2 including the image-bearing member protecting agent 21 in the image forming apparatus 100, the protective layer 1*d* for image bearing member can be suitably formed on the photoconductor drum surface 1*a*. Thus, the photoconductor drum 1 can be used for a fairly long period of time without being replaced, and high quality images can be obtained in a stable manner for a long period of time.

Particularly, when the photoconductor drum 1 contains a thermosetting resin in the protective layer 1*d* which is formed as the outermost surface layer, the image-bearing member protecting agent 21 can protect the photoconductor drum 1 from being deteriorated by electrical stress, and thus the image-bearing member protecting agent allow the photoconductor drum 1 containing the thermosetting resin to continuously provide long durability against mechanical stress applied thereon. Thus, it is possible to greatly lengthen the period of time for which the process cartridge can be used without being replaced. Therefore, high quality images can be obtained in a stable manner for a long period of time.

The charging roller 3 serving as a charging unit, which is located in contact with or close to the photoconductor drum surface 1*a*, is greatly affected by electrical stress since a discharge area lies very close to the photoconductor drum 1. However, by forming the protective layer 1*d* on the photoconductor drum surface 1*a*, the photoconductor drum 1 can be used without being exposed to electrical stress. The photoconductor drum 1 can be used for a fairly long period of time without being replaced, and high quality images can be obtained in a stable manner for a long period of time.

Because the protecting layer 1*d* formed on the photoconductor drum surface 1*a* extremely minimizes changes in the surface condition, cleaning can be stably performed for a long period of time even in the case of using a toner having a large circularity or a toner having a small average particle diameter, in which the quality of cleaning greatly varies depending on change in the condition of the photoconductor drum 1.

By constituting a process cartridge 50 using the protective layer forming device 2 which includes the image-bearing member protecting agent 21 of the present embodiment, it is possible to greatly lengthen the period of time for which the process cartridge 50 can be used without being replaced. Therefore, low running cost and reduction of large amount of waste can be achieved. Particularly, when photoconductor drum 1 contains a thermosetting resin in the protective layer 1*d* formed as the outermost surface layer, the image-bearing member protecting agent 21 can protect the photoconductor drum 1 from being deteriorated by electrical stress caused by the charging roller 3, and thus the image-bearing member protecting agent 21 can continuously provide long durability against mechanical stress applied on the photoconductor drum 1 containing the thermosetting resin.

As described above, since the image-bearing member protecting agent 21 contains virtually no metal component, the charging roller 3 located in contact with or close to the photoconductor drum surface is not smeared with a metal oxide or the like, and thus the charging roller 3 less changes over time. Therefore, the components of the process cartridge, such as the photoconductor drum 1, the charging roller 3 and the like can be easily reused, and further reduction of the amount of waste can be achieved.

What is claimed is:

1. An image-bearing member protecting agent, comprising:

a fatty acid metal salt, the fatty acid metal salt being zinc stearate, and boron nitride, wherein the boron nitride has an oxygen content of 1.2% by mass to 2.7% by mass, wherein an amount of the boron nitride is added to the fatty acid metal salt with a range from 10% by mass to 50% by mass, and wherein the image-bearing member protecting agent is applied or attached onto a surface of an image bearing member.

2. The image-bearing member protecting agent according to claim 1, wherein the fatty acid metal salt is at least one selected from the group consisting of zinc stearate, calcium stearate, and zinc laurate.

3. An image forming apparatus, comprising:

an image bearing member which bears a toner image formed of a toner, a transfer unit configured to transfer the toner image onto a transfer medium, and a protective layer forming device which applies or attaches an image-bearing member protecting agent onto a surface of the image bearing member, from which the toner image has been transferred onto the transfer medium, wherein the image-bearing member protecting agent includes:

a fatty acid metal salt, the fatty acid metal salt being zinc stearate, and boron nitride, wherein the boron nitride has an oxygen content of 1.2% by mass to 2.7% by mass, and wherein an amount of the boron nitride is added to the fatty acid metal salt with a range from 10% by mass to 50% by mass.

4. The image forming apparatus according to claim 3, further comprising a cleaning unit located on a downstream side of the transfer unit and on an upstream side of the protective layer forming device with respect to the rotational direction of the image bearing member and configured to be rubbed against the surface of the image bearing member so as to remove the toner remaining thereon.

5. The image forming apparatus according to claim 3, wherein the image bearing member comprises a thermosetting resin at least in a protective layer formed as an outermost surface layer.

6. The image forming apparatus according to claim 3, wherein the image bearing member is a photoconductor.

7. The image forming apparatus according to claim 5, further comprising a charging unit located in contact with or close to the surface of the image bearing member.

8. The image forming apparatus according to claim 7, further comprising a voltage applying unit configured to apply to the charging unit a voltage which includes an alternating-current component.

9. The image forming apparatus according to claim 7, wherein the toner has a circularity SR in a range of 0.93 to 1.00, wherein Circularity SR=Circumferential length of a circle having the same area as projected particle area/Circumferential length of projected particle image 1.

10. The image forming apparatus according to claim 3, wherein a ratio D4/D1 of a mass average particle diameter D4 of the toner to a number average particle diameter D1 of the toner is in the range of 1.00 to 1.40.

11. A process cartridge, comprising:

an image bearing member which bears a toner image formed of a toner, and a protective layer forming device configured to apply or attach an image-bearing member protecting agent onto a surface of the image bearing member, from which the toner image has been transferred onto a transfer medium, wherein the image-bearing member protecting agent includes:

a fatty acid metal salt, the fatty acid metal salt being zinc stearate, and boron nitride, wherein the boron nitride has an oxygen content of 1.2% by mass to 2.7% by mass, and wherein an amount of the boron nitride is added to the fatty acid metal salt with a range from 10% by mass to 50% by mass.

12. The process cartridge according to claim 11, further comprising a cleaning unit located on an upstream side of the protective layer forming device with respect to the rotational direction of the image bearing member and configured to be rubbed against the surface of the image bearing member so as to remove the toner remaining thereon.

13. The process cartridge according to claim 11, wherein the image bearing member contains a thermosetting resin at least in a protective layer formed as an outermost surface layer.

14. The process cartridge according to claim 11, further comprising a charging unit located in contact with or close to the surface of the image bearing member.

15. The process cartridge according to claim 11, wherein the toner has a circularity SR in a range of 0.93 to 1.00, wherein Circularity SR=Circumferential length of a circle having the same area as projected particle area/Circumferential length of projected particle image.

16. The process cartridge according to claim 11, wherein a ratio D4/D1 of a mass average particle diameter D4 of the toner to a number average particle diameter D1 of the toner is in the range of 1.00 to 1.40.

17. The image-bearing member protecting agent according to claim 1, wherein the boron nitride is NX5.

18. The image-bearing member protecting agent according to claim 1, wherein the image-bearing member protecting agent is powder formed into a block shape.

19. The image forming apparatus according to claim 3, wherein the image-bearing member protecting agent is powder formed into a block shape.

20. The process cartridge according to claim 11, wherein the image-bearing member protecting agent is powder formed into a block shape.

* * * * *